US006779964B2

(12) United States Patent
Dial

(10) Patent No.: US 6,779,964 B2
(45) **Date of Patent: *Aug. 24, 2004**

(54) VISCOUS DRAG IMPELLER COMPONENTS INCORPORATED INTO PUMPS, TURBINES AND TRANSMISSIONS

(76) Inventor: Daniel Christopher Dial, SE. 141 Mill Creek Rd., Shelton, WA (US) 98584

( * ) Notice: Subject to any disclaimer, the term of this patent is extended or adjusted under 35 U.S.C. 154(b) by 0 days.

This patent is subject to a terminal disclaimer.

(21) Appl. No.: 10/165,545

(22) Filed: Jun. 7, 2002

(65) Prior Publication Data

US 2003/0002976 A1 Jan. 2, 2003

Related U.S. Application Data

(63) Continuation-in-part of application No. 09/745,384, filed on Dec. 20, 2000, now abandoned, which is a continuation of application No. PCT/US00/35514, filed on Dec. 20, 2000, which is a continuation of application No. 09/471,705, filed on Dec. 23, 1999, now Pat. No. 6,375,412.

(51) Int. Cl.[7] ..... F01D 1/36

(52) U.S. Cl. ..... 415/1; 415/90; 415/160; 415/80; 415/202; 415/902; 416/198 A; 416/198 R; 60/805

(58) Field of Search ..... 415/56.2, 80, 90, 415/121.2, 149.1, 151, 159, 160, 206, 229, 202, 902, 155; 416/185, 198 A, 198 R, 223 B; 60/805

(56) References Cited

U.S. PATENT DOCUMENTS

| | | | | |
|---|---|---|---|---|
| 1,013,248 A | | 1/1912 | Wilkinson | |
| 1,061,142 A | | 5/1913 | Tesla | |
| 1,061,206 A | | 5/1913 | Tesla | |
| 2,321,907 A | | 6/1943 | Gent | 230/129 |
| 2,598,678 A | * | 6/1952 | Dennis | 415/90 |
| 2,622,859 A | | 12/1952 | Gettins | 261/84 |
| 2,850,229 A | | 9/1958 | Stalker | 230/134 |
| 2,924,439 A | | 2/1960 | Dutton, Jr. | 259/7 |
| 2,952,448 A | | 9/1960 | Cornell | 259/9 |
| 3,017,848 A | | 1/1962 | Bishop | 115/16 |
| 3,037,459 A | | 6/1962 | Nelden | 103/115 |
| 3,045,428 A | * | 7/1962 | McLean | 60/805 |
| 3,226,012 A | | 12/1965 | Trask | 230/117 |
| 3,275,223 A | | 9/1966 | Fowell | 230/125 |
| 3,610,770 A | | 10/1971 | Hendriks | 415/159 |
| 3,923,417 A | | 12/1975 | Swiecicki | 415/110 |
| 4,036,584 A | | 7/1977 | Glass | 415/90 |
| 4,186,554 A | * | 2/1980 | Possell | 60/39.37 |
| 4,218,177 A | | 8/1980 | Robel | 415/90 |
| 4,255,081 A | * | 3/1981 | Oklejas et al. | 415/90 |
| 4,347,032 A | | 8/1982 | Possell | 415/90 |
| 4,403,911 A | | 9/1983 | Possell | 415/90 |
| 4,548,545 A | * | 10/1985 | Lewis et al. | 415/90 |
| 4,609,327 A | | 9/1986 | Nishimori | 415/121 |
| 4,773,819 A | * | 9/1988 | Gurth | 415/90 |
| 5,118,961 A | | 6/1992 | Gamell | 290/52 |

(List continued on next page.)

OTHER PUBLICATIONS

PCT International Search Report; In re Dial, Daniel Christopher.; International Application No. PCT/US00/35514, filed Dec. 20, 2000.

*Primary Examiner*—Ninh H. Nguyen
(74) *Attorney, Agent, or Firm*—Ann W. Speckman; Lisa N. Benado

(57) ABSTRACT

The present invention relates generally to systems and methods for facilitating the movement of fluids, transferring mechanical power to fluid mediums, as well as deriving power from moving fluids. The present invention employs an impeller system in a variety of applications involving the displacement of fluids, including for example, any conventional pumps, fans, compressors, generators, circulators, blowers, generators, turbines, transmissions, various hydraulic and pneumatic systems, and the like.

16 Claims, 17 Drawing Sheets

U.S. PATENT DOCUMENTS 5,191,247 A * 3/1993 Possell ..... 310/62
5,192,182 A * 3/1993 Possell ..... 415/90
5,192,183 A 3/1993 Wilkinson ..... 415/90
5,224,821 A 7/1993 Ozawa ..... 416/169.1
5,297,926 A 3/1994 Negishi ..... 415/90
5,372,499 A 12/1994 Motomura et al. ..... 432/176
5,388,958 A 2/1995 Dinh ..... 415/90
5,419,679 A 5/1995 Gaunt et al. ..... 415/90
5,470,197 A 11/1995 Cafarelli ..... 415/90
6,071,072 A 6/2000 Chang ..... 415/56.2
6,375,412 B1 * 4/2002 Dial ..... 415/90

(List continued on next page.)

VISCOUS DRAG IMPELLER COMPONENTS INCORPORATED INTO PUMPS, TURBINES AND TRANSMISSIONS

CROSS-REFERENCE TO RELATED APPLICATIONS

This application is a continuation-in-part of U.S. patent application Ser. No. 09/745,384, filed Dec. 20, 2000 now abandoned, which is a continuation of PCT/US00/35514 Dec. 20, 2000 which is a continuation of U.S. patent application Ser. No. 09/471,705, filed Dec. 23, 1999 now U.S. Pat. No. 6,375,412.

BACKGROUND OF THE INVENTION

1. Field of the Invention

The present invention relates generally to systems and methods for facilitating the movement of fluids, transferring mechanical power to fluid mediums, as well as deriving power from moving fluids. The present invention employs an impeller system in a variety of applications involving the displacement of fluids, including for example, any conventional pump, fan, compressor, generator, turbine, transmission, various hydraulic and pneumatic systems, and the like.

2. Description of Prior Art

Various forms of impeller systems have been employed in a diversity of inventions, including turbines, pumps, fans, compressors, homogenizers, as well as other devices. The common link between these devices is the displacement of fluid, in either a gaseous or liquid state.

Impeller systems may be broadly categorized as having either a single rotor assembly, such as a water pump (U.S. Pat. No. 5,224,821) or homogenizer (U.S. Pat. No. 2,952,448); or a single radially arranged multi-vaned assembly, such as a fan or blower (U.S. Pat. No. 5,372,499); or a multi-disc assembly mounted on a central shaft, as in a laminar flow fan (U.S. Pat. No. 5,192,183). Impeller systems employing vanes, blades, paddles, etc. operate by colliding with and pushing the fluid being displaced. This type of operation introduces shocks and vibrations to the fluid medium resulting in turbulence, which impedes the movement of the fluid and ultimately reduces the overall efficiency of the system. One of the inherent advantages of a multi-disc impeller system is obviating this deficiency by imparting movement to the fluid medium in such a manner as to allow movement along natural lines of least resistance, thereby reducing turbulence.

U.S. Pat. No. 1,061,142 describes an apparatus for propelling or imparting energy to fluids comprising a runner set having a series of spaced discs fixed to a central shaft. The discs are centrally attached to the shaft running perpendicular to the discs. Each disc has a number of central openings, with solid portions in-between to form spokes, which radiate inwardly to the central hub, through which a central shaft runs, providing the only means of support for the discs.

Similarly, U.S. Pat. No. 1,061,206 discloses the application of a runner set similar to that described above for use in a turbine or rotary engine. The runner set comprises a series of discs having central openings with spokes connecting the body of the disc to a central shaft. As in the aforementioned patent, the only means of support for the discs is the connection to the central shaft.

The designs of the disc and runner set of the aforementioned pump and turbine have significant shortcomings. For example, the discs have a central aperture with spokes radiating inwardly to a central hub, which is fixedly mounted to a perpendicular shaft. The only means of support for the discs are the spokes radiating to the central shaft. The disc design, the use of a centrally located shaft, and the means of connecting the discs to the central shaft, individually, and especially in combination, create turbulence in the fluid medium, resulting in an inefficient transfer of energy. As the discs are driven through a fluid medium, the spokes collide with the fluid causing turbulence, which is transmitted to the fluid in the form of heat and vibration, and the centrally oriented shaft interferes with the fluid's natural path of flow causing excessive turbulence and loss of efficiency. Additionally, the spoke arrangement colliding with the fluid medium creates cavitations, which in turn, may cause pitting or other damage to the surfaces of components. And finally, the arrangement of the runner set does not sufficiently support the discs during operation, resulting in a less efficient system.

U.S. Pat. No. 5,118,961 describes a fluid driven turbine generator utilizing a single rotor having magnets secured in a receptacle shaped portion and spinning about a stationary core to produce electricity. Fluid jets drive the single rotor by impinging on a circumferential roughened surface of the receptacle shaped portion of the rotor. The present invention is distinct from the above in that it employs a multi-disc impeller system rather than a single rotor.

There is a need in the art for a more efficient means of displacing fluids and generating power from propelled fluids without introducing unnecessary turbulence to the fluid medium and loss of energy transfer through heat and vibration. The present invention alleviates the shortcomings of the art and is distinct from conventional systems. The present invention provides a compact, efficient and versatile system for driving fluids and generating power from propelled fluids.

SUMMARY OF THE INVENTION

The present invention provides systems and methods for facilitating the movement of fluids, transferring mechanical power to fluid mediums, as well as deriving power from moving fluids. Embodiments of the present invention exploit the natural physical properties of fluids to create a more efficient means of driving fluids as well as transferring power from propelled fluids. An impeller assembly is provided that may be incorporated into a wide range of devices, such as pumps, fans, compressors, generators, circulators, blowers, generators, turbines, transmissions, various hydraulic and pneumatic systems, and the like. According to one aspect of the present invention, an impeller assembly is provided comprising a plurality of substantially flat discs, a plurality of spacing elements, a plurality of connecting elements, at least one central hub and one or more support plates. The plurality of discs and spacing elements are alternately arranged in a parallel fashion along a central rotational axis and held in tight association by connecting elements forming a stacked array. One or more first support plates may be fixedly connected to, or integral with, the central hub. The stacked array of discs and associated elements are fixedly connected to the first support plate or plates and thereby interconnected to the central hub. A second one or more support plates is fixedly connected to the opposing end of the stacked array of discs, thereby providing structural integrity to the impeller assembly.

According to another aspect of the present invention, each disc comprises a viscous drag surface area having a central aperture. The viscous drag surface area is essentially flat and devoid of any substantial projections, grooves, vanes and the like. Discs of the present invention further comprise one or more support structures, such as a series of support islets, located on the inside perimeter of the disc for receiving spacing and/or connecting elements.

According to a further aspect of the present invention, discs are interconnected by conventional structural elements, such as spacers and connecting rods, attached to the interior perimeter of each disc and supporting plate. The connecting rods in turn are attached to the central hub. Connected to the shaft of the central hub assembly is a mechanism for rotating the central hub and impeller assembly, such as a motor or some similar mechanism. In alternative embodiments, the central hub may be connected to any conventional rotational energy translating mechanism, such as drive shafts and the like.

In accordance with further aspects of the present invention, the parallel arrangement of the discs' central apertures of the stacked array generally define a central cavity of the impeller assembly, creating a fluid conduit. In addition, the plurality of intermittently arranged discs, spacing, and connecting elements define a plurality of inter-disc spaces which is continuous with the central cavity of the staked array. Fluid may flow freely between the plurality of inter-disc spaces and the central cavity of the stacked array. According to yet other aspects, the present invention provides systems and methods wherein the impeller assembly works in conjunction with the interior surface of a housing to create zones of high and low pressure within the impeller assembly and internal chamber of the housing causing the fluid medium to drawn into and eventually expelled from the pump system. Pump systems of the present invention further comprise a mechanism for rotating the impeller assembly such that the plurality of discs are rotationally driven through the fluid medium, which displaces and accelerates the fluid through viscous drag to impart tangential and centrifugal forces to the fluid with continuously increasing velocity along a spiral path, causing the fluid to be discharged from an outlet. The principle of operation is based on the inherent physical properties of adhesion and viscosity of the fluid medium, which when propelled, allows the fluid to adjust to natural streaming patterns and to adjust its velocity and direction without the excessive shearing and turbulence associated with traditional vane-type rotors or impellers.

According to the present invention, as discs of the impeller assembly are rotated and driven through the fluid medium, the fluid layer in immediate contact with the discs is also rotated due to the strong adhesion forces between fluid and disc. The fluid is subjected to two forces, one acting tangentially in the direction of rotation, and the other centrifugally in an outward radial direction. The combined effects of these forces propels the fluid with continuously increasing velocity in a spiral path The fluid increases in velocity as it moves through the inter-disc spaces causing zones of negative pressure. The continued movement of the accelerating fluid from the inside perimeter of the discs to the outside perimeter draws fluid from the central cavity of the impeller assembly, which is essentially continuous with an inlet port. The net negative pressure created within the internal chamber of the pump draws fluid from an outside source. As fluid is accelerated through the inter-disc spaces to the outside perimeter of the discs, the continued momentum drives the fluid against the inner wall of the housing chamber creating a zone of higher pressure defined by the gap between the outside perimeter of the discs and the inner wall of the housing chamber. The fluid is driven from the zone of relative high pressure to a zone of ambient pressure defined by the outlet port and any further connections to the system.

According to further aspects of the present invention, the flow rate is generally in proportion to the dimensions and rotational speed of the discs. As the surface area of the discs is increased by increasing the viscous drag surface area, so too is the amount of fluid in intimate contact with the discs, and therefore the greater the amount of fluid being driven, increasing the flow rate. As the number of discs is increased, the overall viscous drag surface area increases, which results in an increased flow rate. In addition, as the rotational speed of the impeller assembly is increased, the greater the tangential and centripetal forces being applied to the fluid, which will naturally increase the flow rate of the fluid.

According to further aspects, methods and systems of the present invention may be applicable to any system facilitating the movement of fluids, transferring mechanical power to fluid mediums, as well as deriving power from moving fluid mediums, such as, for example, pumps, pneumatic and/or hydraulic pumps, hydraulic and/or pneumatic compressors, jet pumps, marine jet pumps, any conventional air circulators, blowers and/or fans, pumps and circulating pumps, pumps and circulating pumps for any conventional engine and/or motor, appliance fans and/or pumps, electronic component fans/blowers/circulators, pool and fountain circulating pumps, propulsion jets for baths and spas, air humidifiers, well and sump pumps, vacuum pumps, turbines, jet turbines, transmissions, generators, fluid-powered generators, wind-powered generators, pressurized hydraulic and pneumatic systems, and the like.

According to still yet further aspects of the present invention, methods and systems are provided which generate little heat during operation thereby minimizing consequential heating of the fluid medium. Therefore, systems incorporating impeller systems of the present invention are particularly well suited for displacing low temperature liquids, such as liquefied gases.

According to further aspects, pump and/or circulating systems incorporating impeller assemblies of the present invention may be used to displace temperature and turbulence sensitive fluids, such as food products and biological fluids.

According to still further aspects of the present invention, impeller assemblies of the present invention may be incorporated into medical devices and apparatus involved with the movement of fluids, such as devices for moving biological fluids, medicines, therapeutics, pharmaceutical preparations, and the like. Examples may include heart pumps, circulatory pumps of all sorts, such as in heart and lung bypass apparatus, dialysis, and plasmaphoresis devices, as well as injection pumps for the delivery of medicines, therapeutics, pharmaceutical preparations and the like.

Impeller assemblies and systems incorporating impeller assemblies of the present invention have significant advantages over the prior art. The multi-disc impeller assembly possesses significantly more surface area in comparison to single rotor designs. The increased surface area in combination with viscous drag operation creates a superior design. Elimination of the central shaft and creation of a central cavity within the impeller assembly contributes to efficiency. As previously mentioned, the central shaft of conventional designs impedes the natural flow of fluid through the impeller system and also contributes to turbulence and loss of energy transfer by generating heat and vibration. By employing a central hub design, a central cavity of the impeller system is created, which permits fluid to flow unobstructed through the impeller assembly, thereby reducing unnecessary friction and turbulence.

Other aspects of the present invention provide a number of embodiments incorporating impeller assemblies, such as a pump system. Pump systems of the present invention may be used to displace all forms of fluids, whether liquid or gaseous, and is equally well suited for high volume and/or high pressure applications as well as low to medium pressure applications. Pump systems of the present invention comprise an impeller assembly, as generally described above, and any conventional housing and associated components.

In accordance with another aspect of the present invention, jet pumps, such as a marine jet pump are provided. As with the previously described pump system, jet pumps of the present invention utilize an impeller assembly and employ the same principles of operation. The impeller assembly is rotationally driven through the fluid medium causing the fluid to accelerate, the resultant negative pressure within the housing draws fluid from the external environment through a specialized conduit and is eventually discharged through an exhaust port to supply the propulsive force. In certain embodiments, the exhausted fluid is preferably attached to a standard marine directional nozzle to direct the fluid stream. The present invention eliminates the use of the standard multi-blade or vane impeller systems, resulting in less turbulence and loss of energy through generation of heat and vibration. In addition, impeller assemblies of the present invention are also resistant to wear from the abrasive action of suspended particulates in the fluid medium.

According to yet another aspect of the present invention, turbines are provided, such as hydroelectric and fluid turbines. These embodiments of the present invention also employ a similar impeller assembly, but, rather than applying power to the impeller assembly for the displacement of fluids, the hydroelectric turbine provides power through the impeller assembly via propelled fluids. The same fundamental principles of fluid dynamics and transfer of energy apply, but in reverse. The kinetic energy of the fluid is transferred to the impeller assembly to provide rotational movement to the shaft, which is harnessed by any conventional mechanisms. According to yet another aspect of the present invention, a fluid turbine is provided. Similar to the hydroelectric turbine, the kinetic energy of the fluid is transferred to the impeller assembly to provide rotational movement to the shaft, which is harnessed in any number of ways. The same fundamental principles of fluid dynamics and transfer of energy apply as previously described apply. Subcomponents of the impeller assembly for this embodiment have several modifications to accommodate the method of operation. These modifications, as well as a detailed description of the embodiment, are described below in the detailed description of the preferred embodiments.

According to another aspect of the present invention, a turbine transmission is provided. This embodiment comprises a number of subsystems, including a turbine section, a pump section, a sump assembly and a high-pressure line interconnecting the pump and turbine sections. The subsystems are combined to form a closed system through which a fluid medium flows. This embodiment is particularly useful for driving items with a soft engagement requirement, such as motion sensitive machinery, marine use and most any other application requiring especially smooth, quiet and efficient transfer of power. The turbine transmission is especially adaptable to close quarters installation requirements and offers significantly lower noise and vibration levels during operation. Many of the features of the sub-components of the turbine transmission, as well as principles of operation, are described in the detailed description of the pump and the fluid turbine. Additional modifications and features will be described in detail below.

A further aspect of the present invention may provide a fuel turbine having a compressor impeller assembly and/or a power impeller assembly and a gear section having a shaft extending from the compressor to the power impeller assemblies. A starter, such as a starter shaft, may also be included to activate the compressor impeller assembly. The compressor impeller assembly may include a central hub that may radially move, a stacked array of parallel discs to create high pressure in a fluid and a fluid outlet to release the high pressure fluid. Each disc may have a central aperture and be inter-spaced along a parallel axis. Upon radial movement of the central hub, a fluid may flow through the central apertures of the stacked array of discs and the spaces between the discs to increase the pressure of the fluid. The power impeller assembly may comprise a combustor to introduce the high pressure fluid to the fuel and to ignite the fuel. The combustor may have a fluid inlet to receive the released high pressure fluid and a fuel inlet to receive fuel. The power impeller assembly may further comprise a central hub and a stacked array of parallel discs, each disc having a central aperture and being inter-spaced along a parallel axis. Upon ignition of the fuel, a fluid may flow across the stacked array of discs.

In some embodiments of the fuel turbine, at least two rods extend through the discs of the power impeller assembly and/or compressor impeller assembly and one end of the rods is attached to a support frame at rod attachments. The support frame may also include a shaft attachment.

Other aspects of the present invention relate to a support frame that may be employed in any of the various embodiments of an impeller assembly as described herein, having a stacked array of parallel inter-spaced discs and at least two rods extending through the array of discs. The support frame may comprise at least two rod attachments for securing one end of a rod to the array of discs, and at least two arms having a first arm end being coupled to at least one of the rod attachment. The support frame may further include a shaft attachment, which may be coupled to a second arm end.

BRIEF DESCRIPTION OF THE FIGURES

FIGS. 6A and 6B show various embodiments of support frame, wherein FIG. 6A shows a support frame for four rods and FIG. 6B shows a support frame for three rods and a center shaft.

DETAILED DESCRIPTION OF THE INVENTION

The present invention generally relates to systems and methods for facilitating the movement of fluids, transferring mechanical power to fluid mediums, as well as deriving power from moving fluids.

1. Impeller Assembly in the Context of a Pump System

Referring to FIGS. 1A–E, an impeller assembly incorporated into a pump system and its various components are illustrated. For the sake of clarity, the impeller assembly of the present invention is described in the context of a pump system, but is also utilized in other embodiments described herein and may be incorporated into a wide range of devices, as previously described. Although there may be modifications to the impeller assemblies used in the other embodiments, many of the same general designs, features, sub-components and qualifications described below apply to these modified versions. As a result, the detailed description of the other embodiments will incorporate much of the impeller assembly disclosure provided immediately below.

Figure 1A:
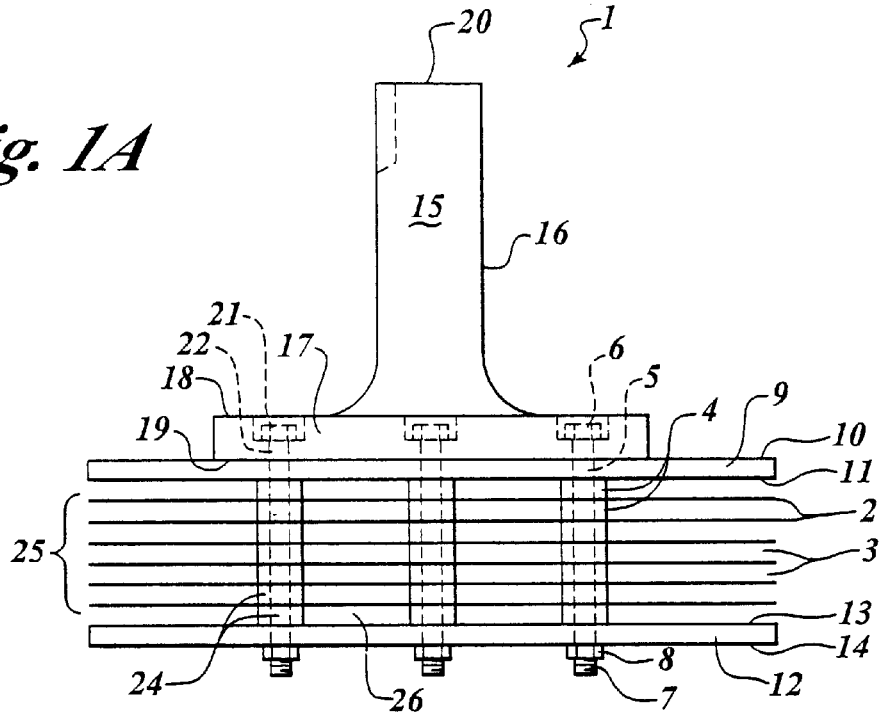
FIG. 1A illustrates a side view of the impeller assembly. For the sake of clarity, only a limited number of discs with wide intervening spaces are illustrated.
Figure 1B:
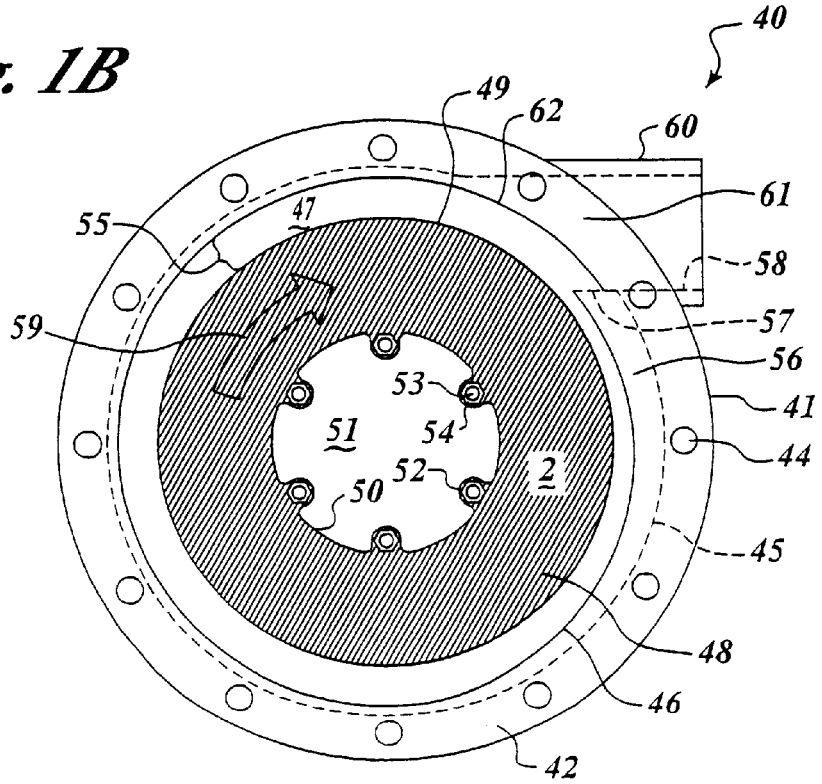
FIG. 1B illustrates the impeller assembly within the pump housing, with the cover removed exposing the inlet-side backing plate.
Figure 1C:
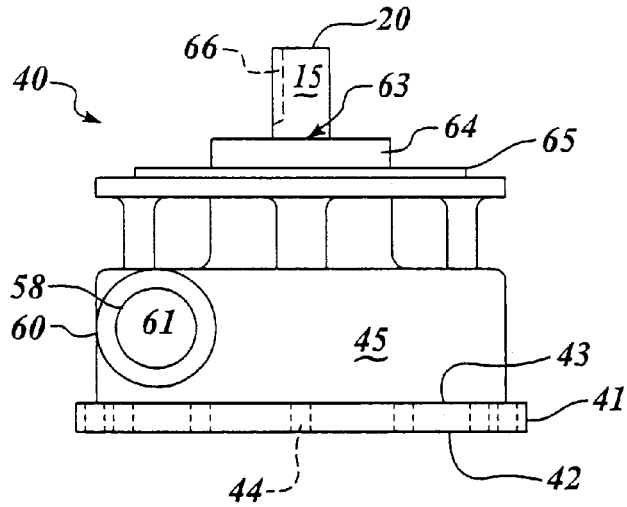
FIG. 1C depicts a side perspective of the pump housing.

Impeller assembly 1 of the pump system illustrated in FIG. 1A comprises a plurality of viscous drag discs 2 arranged parallel to one another with distinct spaces 3 located between each disc. A top perspective of a representative disc 2 is shown in FIG. 1B. Discs 2 are substantially flat with a central aperture 51, which defines an inside perimeter 50 of disc 2. Face 48 of disc 2 forms the viscous drag surface area and defines the outer perimeter 49. The viscous drag surface area of the discs is essentially flat and devoid of any purposefully raised protrusions, engraved texturing, grooves and/or vanes. The surface area need not be completely devoid of any texture, and in certain applications may possess a roughened surface to provide additional friction for displacing fluid, so long as the roughened surface does not create substantial disruptive turbulence in the fluid medium.

Along inner perimeter 50 of discs 2 are a series of support structures, such as support islets 52 protruding into central aperture 51. Alternative embodiments may comprise support structures that do not protrude into central aperture 51 and may include embodiments having support structures inset along inner perimeter 50 of disc 2. Each support islet contains a central aperture 53 which has been undercut 54. Alternative embodiments may comprise support structures, such as support islets 52, that are not undercut and may be essentially flush with, or projecting above, inner perimeter 50 of disc 2. The number of support islets varies depending on the specific application. As described below, support islets 52 serve as a mechanism to interconnect and support a plurality of discs to form a stacked array of impeller assembly 1. A preferred number of support islets may range from 3 to greater than 6, and in the preferred embodiment described herein, 6 are shown. In alternative preferred embodiments, impeller assemblies comprising 3, 4 or 5 support islets are provided.

Discs 2 may be composed of any suitable material possessing sufficient mechanical strength, as well as physical and/or chemical inertness to the fluid medium being displaced, such as, but not limited to, resistance to extreme temperatures, pH, biocompatibility to food products or biological fluids, and the like. Discs 2 may, for example, be composed of metal, metal alloys, ceramics, plastics, and the like. Optionally, discs 2 may be composed of a high-friction material to provide additional surface friction for displacing fluid. The general, the dimensions of disc 2, such as overall circumference, central aperture diameter and width, are variable and determined by the particular use. The size of the housing and the desired flow rate of a particular fluid also influence the size and number of discs in the impeller assembly. Because only the viscous drag surface areas of the discs significantly affect the flow of fluid, it is desirable that the discs of the impeller assembly be as thin as the specific application will allow. Therefore, it is preferable that discs 2 have a thickness capable of maintaining sufficient mechanical strength against stresses, pressures and centrifugal forces generated within the pump, yet as thin as conditions allow to reduce unnecessary turbulence. Discs may be from 1/1000 to several inches in width, depending on the application. The materials and dimensions of the discs are largely dependent on the specific application involved, in particular the viscosity of the fluid, the desired flow rate and the resultant operating pressures. In certain embodiments, particularly small applications, the entire impeller assembly may be made of plastics or other material that may be formed by any conventional methods, such as injection molding, or other comparable method, to form an integrated impeller assembly rather than the individual components described below. Alternatively, embodiments of impeller assembly 1 may be formed of die cast metal, machined metal and/or metal alloy or powdered metal assemblies for applications requiring greater mechanical strength.

The inter-disc spaces 3 between discs 2 is maintained by a plurality of spacers 4, which, together with the discs, create a stacked array of alternating discs and spacers 25. Spacers 4 possess a central aperture 24 complementary with the islet aperture 53 of support islets 52. Spacers 4 may be of any suitable conformation that does not create undue turbulence in the fluid medium, such as round, oval, polygonal, oblong, and the like, and composed of any suitable material compatible with other components of the pump system and the fluid being displaced, such as metals, metal alloys, ceramics and/or plastics. Alternative embodiments of the present invention may have spacers 4 integrated into discs 2 rather than distinct components, such as, but not limited to, one or more raised sections integrated with islets 52 of inner rim 50. The height of spacers 4 is an additional variable in the design of the impeller system and is dependent on the specific application. For example, the inter-disc spacing, and therefore the height of spacers 4, may be from 1/100 to greater than 2 inches, preferably from 1/32 to 1 inch, and more preferably from 1/16 to ½ inch. In general, the spacing of discs should be such that the entire mass of fluid is accelerated to a nearly uniform velocity, essentially equivalent to the velocity achieved at the periphery of the discs, and thereby generating sufficient pressure by the combined centrifugal and tangential forces imparted to the fluid to effectively and efficiently drive the fluid. The greater the height of spacers 4, the greater the inter-disc space 3, which has a direct effect on the negative pressure generated within the pump housing. For example, in low pressure/high volume applications, such as embodiments designed for pumping gases, the inter-disc spacing may be larger than that required for displacing liquids, for example, 1/16 to about ½ inch. Furthermore, displacement of liquid gases may require inter-disc spacing on the low end of the preferred ranges provided above, or if necessary, beyond those ranges for optimal performance.

The number of discs 2 in impeller assembly 1 may vary depending upon the particular use. In preferred embodiments, impeller assembly 1 comprises between 4 and 100 discs and in especially preferred embodiments between 4 and 50 discs.

Impeller assembly 1 further comprises a central hub 15. Central hub 15 serves to transfer rotational power applied to the receiving end 20 of the shaft section 16 to the stacked array 25 of discs. Central hub 15 possesses a flange section 17 distal to the shaft section, having an inside 19 and outside 18 face. Inside face 19 of flange section 17 is in immediate contact with an outside face 10 of a first reinforcing backing plate 9. Alternative embodiments of the present invention also encompass designs wherein central hub 15 and first reinforcing backing plate 9 are one integral work-piece, whether cast or machined. The inside face 11 of first reinforcing backing plate 9 is in immediate contact with a plurality of spacers 4. A second reinforcing backing plate 12, is located distal to the stacked array of spacers and discs 25. In a preferred embodiment, first and second reinforcing backing plates 9, 12 have substantially the same design and dimensions as viscous drag discs 2 shown in FIG. 1B.

As evidenced in the illustration, first and second reinforcing backing plates 9 and 12 of impeller system 1 are considerably thicker than the discs in order to provide additional mechanical support to the stacked array of discs to counteract the negative pressure created in the inter-disc spaces, particularly at the outside periphery of the discs. The reinforcing backing plates serve as a support means for the discs by providing a solid and relatively inflexible surface for the discs to pull against, thereby reducing the tendency of the discs to flex and deflect inwardly in the inter-disc spaces. The thickness of the reinforcing backing plates is largely dependent on the diameter, and therefore the surface area, of the discs. As a general principle, the reinforcing backing plates may be approximately four times as thick as the discs, but this relationship may vary dependent on the particular application.

Central hub 15, first reinforcing backing plate 9, stacked array of spacers and discs 25 and second reinforcing backing plate 12 of the impeller assembly are interconnected by a plurality of connecting rods 5. Distal end 7 of connecting rods 5 pass through apertures 22 of flange section 17 of central hub through the complementary apertures of first reinforcing backing plate, spacers, discs and second reinforcing backing plate 12. Distal end of connecting rods are secured against the outside face of second reinforcing backing plate by any suitable retaining means 8. Proximal end 6 of connecting rods has a securing means that is seated in countersunk opening 21 of apertures 22 of flange section of central hub. Alternative embodiments may not require a countersunk configuration and include any operable configuration of the elements described herein. Retaining device 8, such as a conventional nut threaded onto the distal end of the connecting rod, or any other suitable retaining device, is secured in such a manner as to draw second reinforcing backing plate towards proximal end of connecting rod, thereby drawing all components into tight association. Although the preferred embodiment described herein shows a through-bolt arrangement for connecting the sub-components of the impeller assembly, the present invention also anticipates the use of other similar connecting means, such as a stud-bolt arrangement for the connecting rods, having a threaded proximal and distal end, and a welded-stud arrangement, where the connecting rods are secured to the central hub and the second reinforcing backing plate by welded, soldered or brazed connections.

Figure 6A:
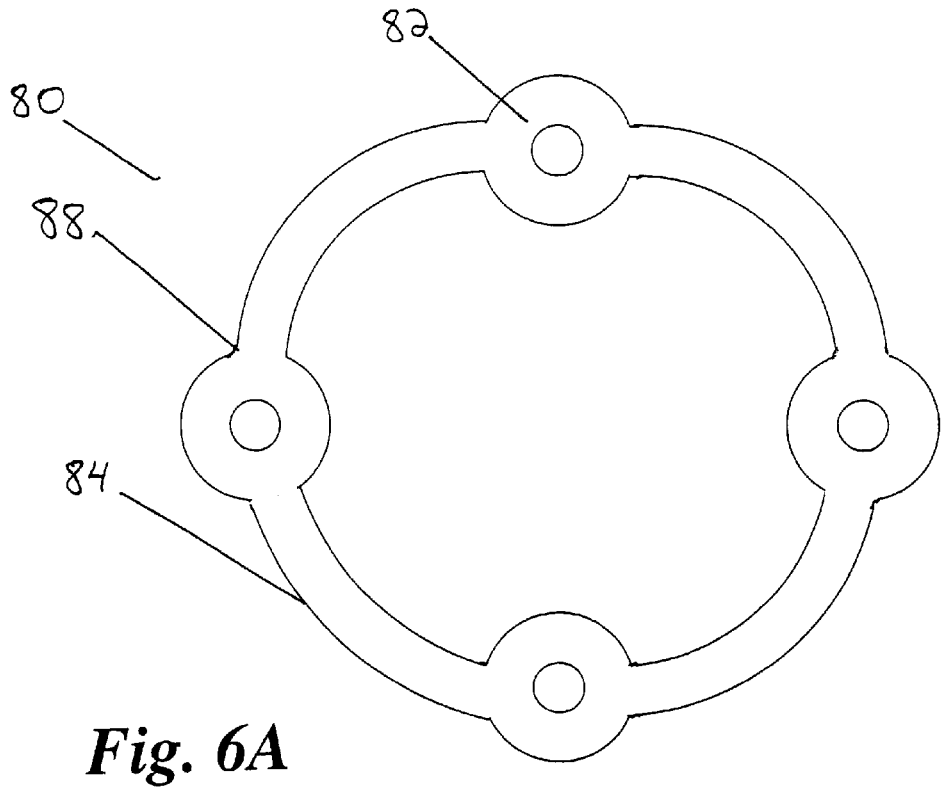
Figure 6B:
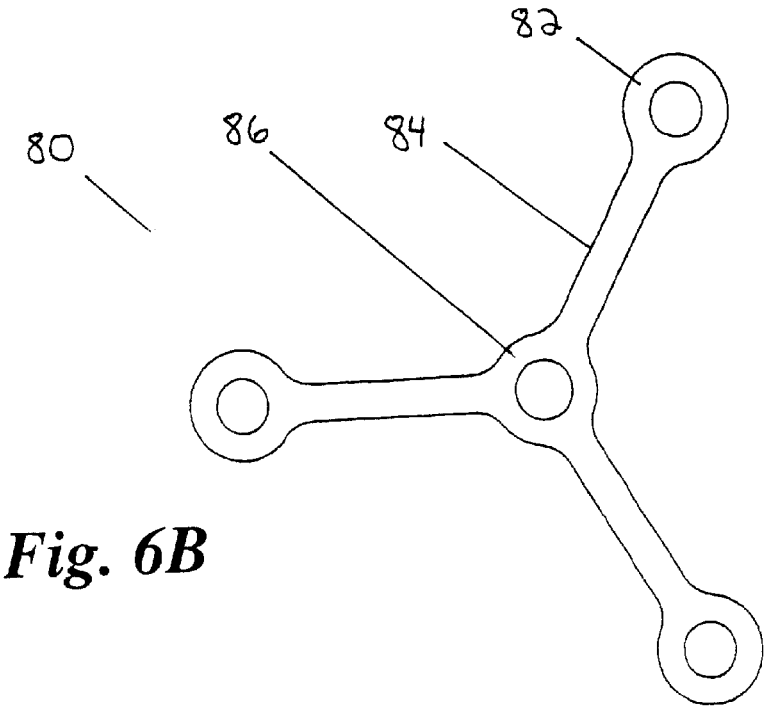

In some embodiments of impeller assembly, a support frame 80 may be provided at one end of the rods to secure the rods, as depicted by various embodiments in FIGS. 6A and 6B. The support frame includes a rod attachment 82, wherein each rod attachment is for holding one of the rods. Where a central hub is included on one end of the array of stacked plates, the support frame may be secured to the opposite end of the array of plates. The support frame may be of various shapes and sizes in order to inhibit movement of the rods. Oftentimes, without the use of a support frame, the high fluid pressure may cause a non-secured end of the rods to shake or otherwise move its position. As a result, the spaces between the plates may vary with rod movement, affecting fluid flow. The support frame may permit more uniform spaces between plates.

FIG. 6A shows a support frame 80 having four rod attachments 82 for supporting four rods. However, any number of rod attachments may be included, depending on the number of rods provided. Various types rod attachments may be employed, which inhibit movement of the rods, such as an opening through which a rod end, such as the distal end of connecting rods, is extended. The opening may permit the retaining device to draw the support frame towards proximal end of connecting rod, thereby drawing all components into tight association, rather than or in addition to securing a second reinforcing backing plate, as described above. The support frame also includes arms 84 coupled to the rods and that may connect to the rods in various patterns, such as a web, circle, square, triangular, etc. At least one arm end 88 is coupled to at least one rod attachment, and at times each arm end is coupled to a different rod attachment. In some embodiments that include a central shaft, the support frame may also include a shaft attachment 86 as depicted in by the exemplary embodiment in FIG. 6B. The shaft attachment may be connected to the rod attachments by arms 84 that each may extend from the shaft attachment at a first arm end 88 and to each of the rod attachments at the other, i.e. second, arm end 88. Oftentimes, the components of the support frame are only as big as necessary to support the rods and/or shaft. For example, the rod and shaft attachments are slightly larger in diameter than the respective rods and shaft. Furthermore, the arms may also have a small diameter. This conservative size of the support frame may result in less disruption to fluid flow, e.g. turbulence, and/or require less material, than other designs that may employ a supporting plate.

The support frame is especially beneficial with embodiments of impeller assemblies that include a large array of stacked discs, such as having a large number of discs and/or spaces there between. The support frame is also useful for applications where the discs rotate very fast. The support frame may stabilize the discs to inhibit any discs from moving off center and/or flexing.

Alignment of the central apertures of the two reinforcing backing plates and the stacked array of discs form a central cavity 26 within the impeller assembly. Supporting the discs and backing plates at the inside perimeter eliminates the central shaft employed in previous designs, as well as the spokes used to attach the discs to the central shaft, thereby eliminating the turbulence created by the central shaft and associated spokes of the discs. Where a shaft does not extend past the first backing plate and into the central cavity, the central cavity may be devoid of a shaft. The central cavity permits the fluid to flow in a more natural line into the impeller assembly without the churning effect of the shaft and spokes.

FIG. 1B illustrates the pump system with the inlet cover and second reinforcing backing plate removed to reveal the most distal disc 2 of the stacked array 25. The housing 40 of the pump system may be of any conventional design that provides a complimentary surface for the impeller assembly. The housing comprises an outer 45 and inner wall 46 of the housing body, forming an interior chamber 47 of sufficient volume to accommodate the impeller assembly, yet maintain a gap 55 between the impeller assembly and the inside wall of the housing. The inner wall 46 provides a complementary surface for the impeller system to draw against, and gap 55 permits movement of the fluid within the housing and to create a zone of high pressure. The volume area defined by the gap 55 affects flow rate and operating pressure. In certain embodiments, the total gap volume should be between 10 and 20% greater than the inlet volume area, but may be smaller or larger, depending on the application. Additional factors to be considered in determining the gap volume are output pressure, and sheer mass, viscosity and particulate size of the fluid medium. The pump housing further comprises a housing flange 41 with a series of holes 44 extending from the face plate 42 of the flange through to the underside 43 of the flange. The inner wall of the housing forms a fluid catch 56 by an inwardly angling extension of the wall to create a shoulder 57, which is continuous with the inner wall 58 of an outlet port 60 having a central aperture 61. The inner wall of the housing has an opening 62 to permit fluid to flow through the central aperture 61 of the outlet port 60. Alternative embodiments may utilize any conventional pump housing incorporating impeller assemblies of the present invention and not be limited to the exemplary embodiment presented herein.

The impeller assembly is oriented within the internal chamber 47 of the housing by threading the receiving end 20 of the central hub 15 through a centrally oriented opening 63 of the bearing/seal assembly 64 such that the shaft section 16 of the central hub is securely held and supported by the bearing/seal assembly. Bearing/seal assembly 64 is integrated into the rear plate 65 of the pump housing by conventional mechanisms. One possible configuration has the bearing/seal as a cartridge unit (although the bearing and seals may be separate units) that is press-fitted on to the shaft and then pressed into the housing, The bearing/seal assembly may be of any conventional configuration that will provide sufficient support for the impeller assembly, permit as friction-free radial movement of the shaft as possible and prevent any leaking of fluid from the internal chamber.

The pump system is driven by any drive system capable of imparting rotational movement to the shaft 16 of the central hub, thereby imparting rotational movement to the entire impeller assembly within the internal cavity of the pump housing. The receiving end 20 of the central hub may be of various configurations, such as keyed, flat, splined, and the like, to allow association with various motor systems. An exemplary embodiment depicts a standard shaft configuration, which has been keyed with a receiving notch 66 formed at the receiving end of the shaft 16 for receiving a complementary retaining device associated with the drive system. Other examples include flex-joints, universal joints, flex-shafts, pulley systems, chain-drive, belt-drive, cog-belt-drive systems, direct-couple systems, and the like. Any drive system, such as a motor or comparable device, that directly or indirectly imparts radial movement to the impeller assembly through the shaft may be employed with the present invention. Suitable drive systems include motors of all types, in particular electrical, internal combustion, solar-driven, wind-driven, and the like.

Figure 1D:
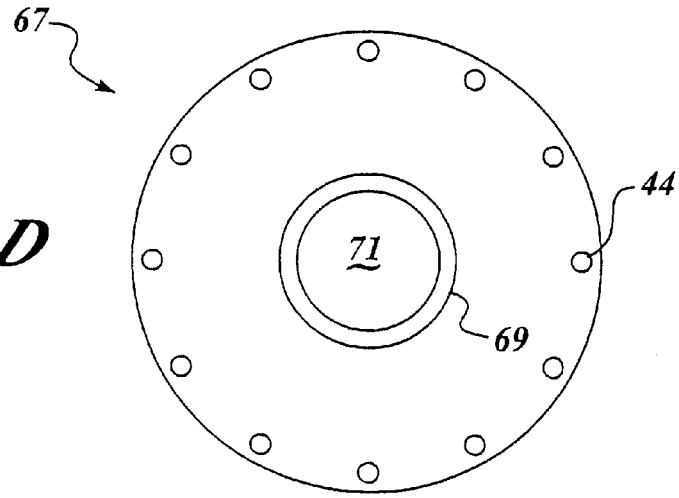
FIG. 1D shows a top view of the pump cover with inlet port.
Figure 1E:
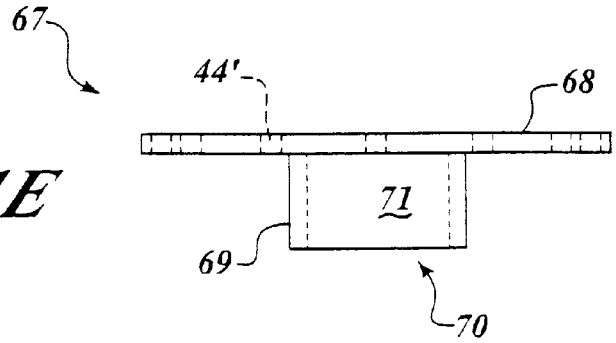
FIG. 1E illustrates a side perspective of the pump cover.

The inlet port cover 67, as shown in FIGS. 1D and 1E has a circumference comparable to the circumference of housing flange 41, and has a series of apertures 44' that are spatially oriented to be complementary to apertures 44 in housing flange 41. Inlet port cover 67 is attached to the pump housing by securing inside face 68 of inlet port cover 67 to face plate 42 of housing flange 41 and fixedly attached by any conventional securing devices through complementary apertures 44, 44'. In the context of the present invention, the term "fixedly" does not necessarily mean a permanent, non-detachable attachment or connection, but is meant to describe a variety of connections well known in the art that form tight, immovable junctions between components. Face plate 42 of inlet port cover 67 defines the ceiling of internal chamber 47 of the pump housing. Fluid is drawn into opening 70 of inlet port 69 and through inlet port conduit 71 to internal chamber 47 of the housing.

Operationally, internal chamber 47 of the pump is primed with a fluid compatible to that being displaced. The drive system is activated to impart radial movement to shaft 16 of central hub 15, turning stacked array of discs 25 through the fluid medium in the direction of arrow 59. Impeller assemblies of the present invention operate in either direction of rotation. As discs 2 of the impeller assembly are driven through the fluid medium, the fluid in immediate contact with viscous drag face 48 of discs is also rotated due to the strong adhesion forces between the fluid and disc. The fluid is subjected to two forces, one acting tangentially in the direction of rotation, and the other centrifugally in an outward radial direction. The combined effects of these forces propels the fluid with continuously increasing velocity in a spiral path The fluid increases in velocity as it moves through the relatively narrow inter-disc spaces 3 causing zones of negative pressure at the inter-disc spaces. The continued movement of the accelerating fluid from inside perimeter 50 of discs to outside perimeter 49 of discs further draws fluid from central cavity 26 of the impeller assembly, which is essentially continuous with inlet port conduit 71 of inlet port 69. The net negative pressure created within internal chamber 47 of the pump draws fluid from an outside source connected by any conventional means to the inlet port.

As fluid is accelerated through inter-disc spaces 3 to outside perimeter 49 of discs 2, the continued momentum drives the fluid against inner wall 46 of housing chamber 47 creating a zone of higher pressure defined by gap 55 between outside perimeter 49 of discs 2 and inner wall 46 of housing chamber 47. The fluid is driven from the zone of relative high pressure to a zone of ambient pressure defined by outlet port 60 and any further connections to the system. The fluid within the system may circulate a number of times before being displaced through the outlet port. Fluid catch 56 of inner wall 46 serves to impel the flow of circulating fluid into the central aperture of the outlet port.

2. Impeller Assembly in the Context of a Jet System

An additional embodiment of the present invention is illustrated in FIGS. 2A–D. The marine jet pump employs essentially the same impeller assembly 1 described above, and therefore attention should be drawn to FIGS. 1A and 1B and the corresponding written description for a detailed disclosure of the impeller assembly, associated components and systems, as well as principles of operation.

Figure 2A:
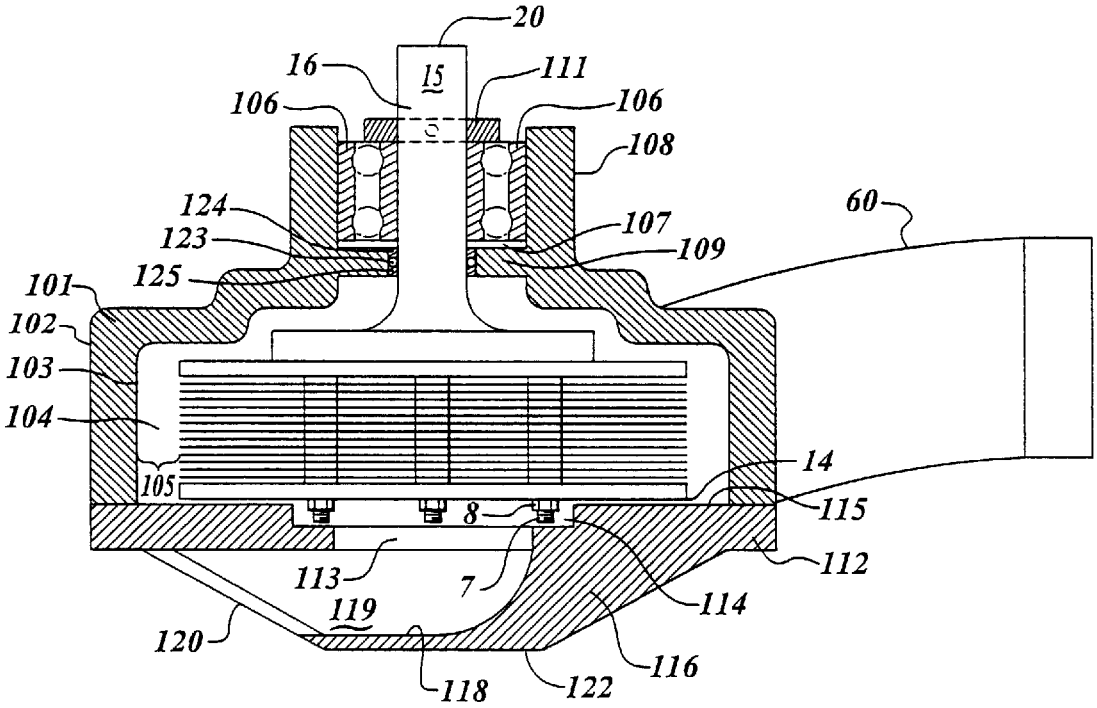
FIG. 2A shows a cross-sectional side perspective of the marine jet pump.
Figure 2B:
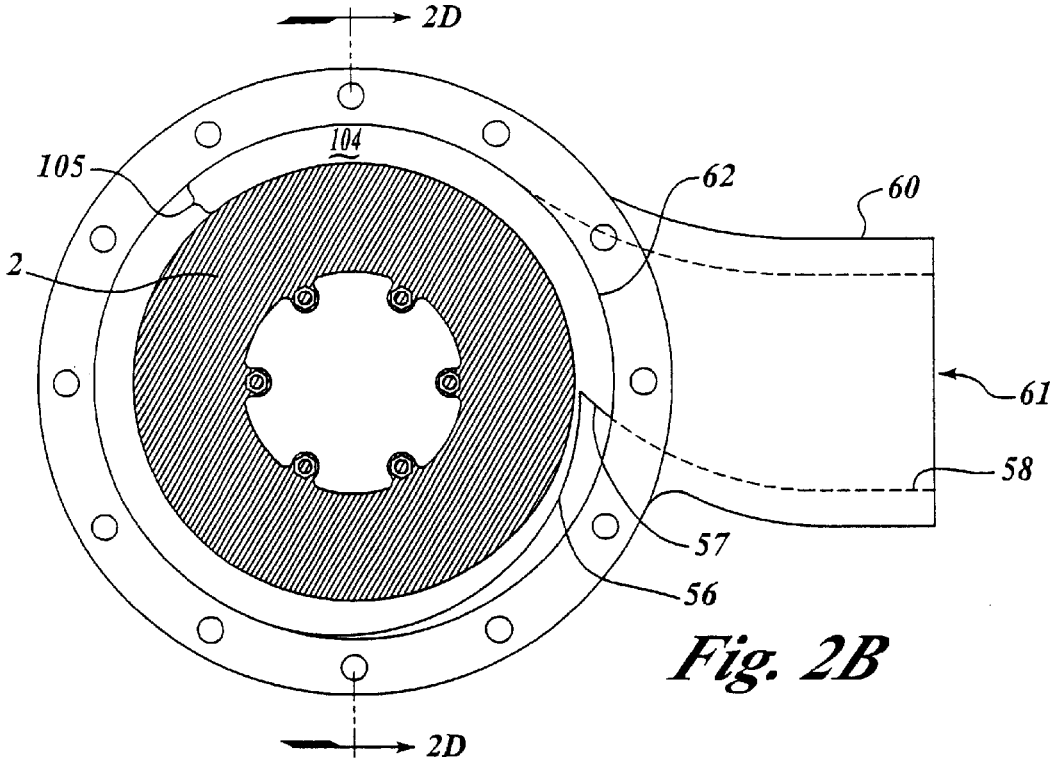
FIG. 2B shows an end-on view of the marine jet pump with the bottom plate cover removed.
Figure 2C:
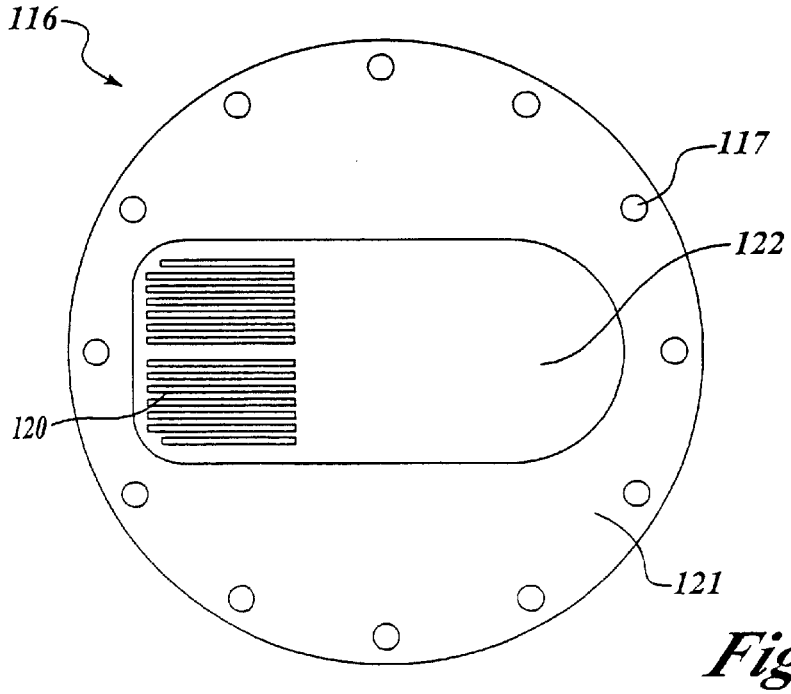
FIG. 2C illustrates the bottom cover plate from a top perspective.
Figure 2D:
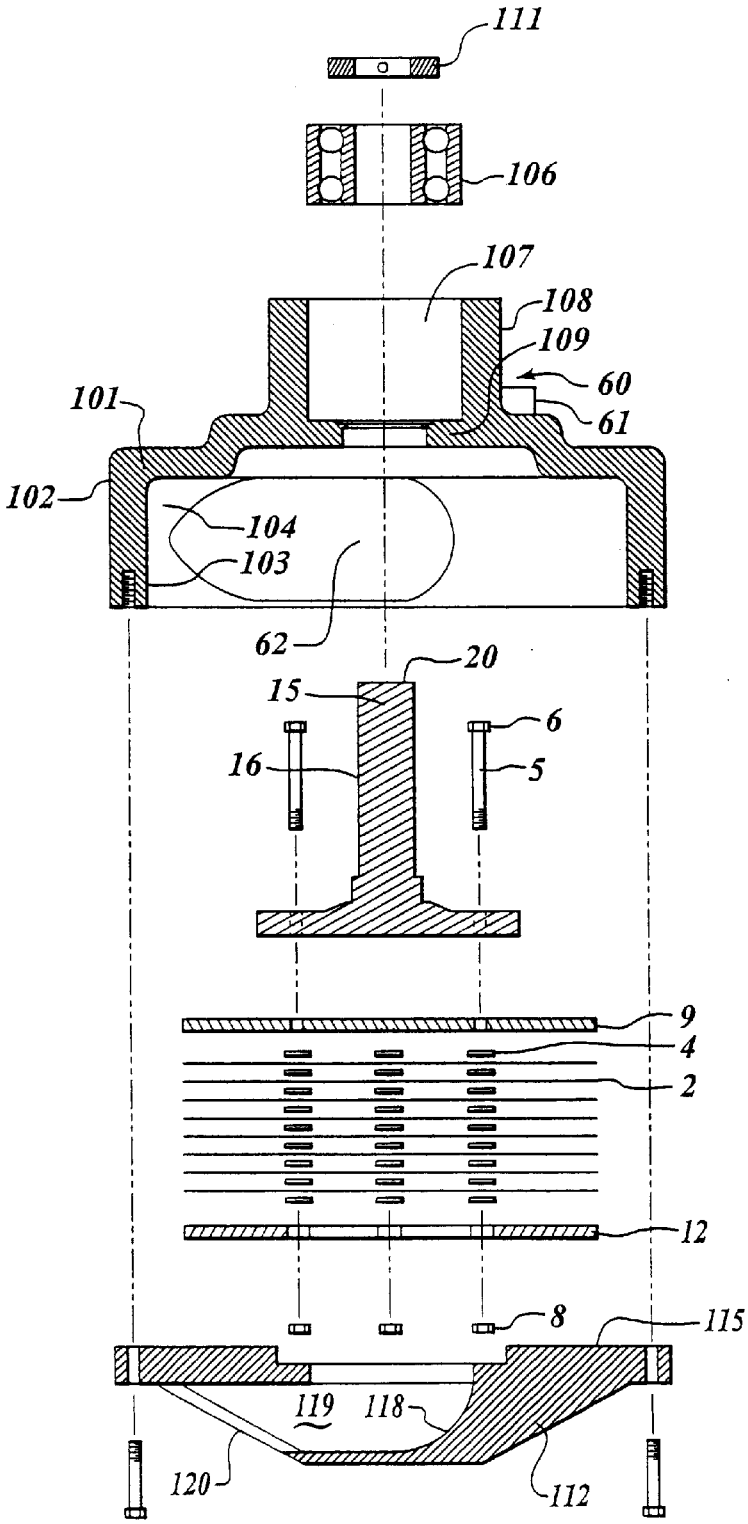
FIG. 2D is an exploded illustration of a cross-sectional side perspective of the marine jet pump.
Figure 3A:
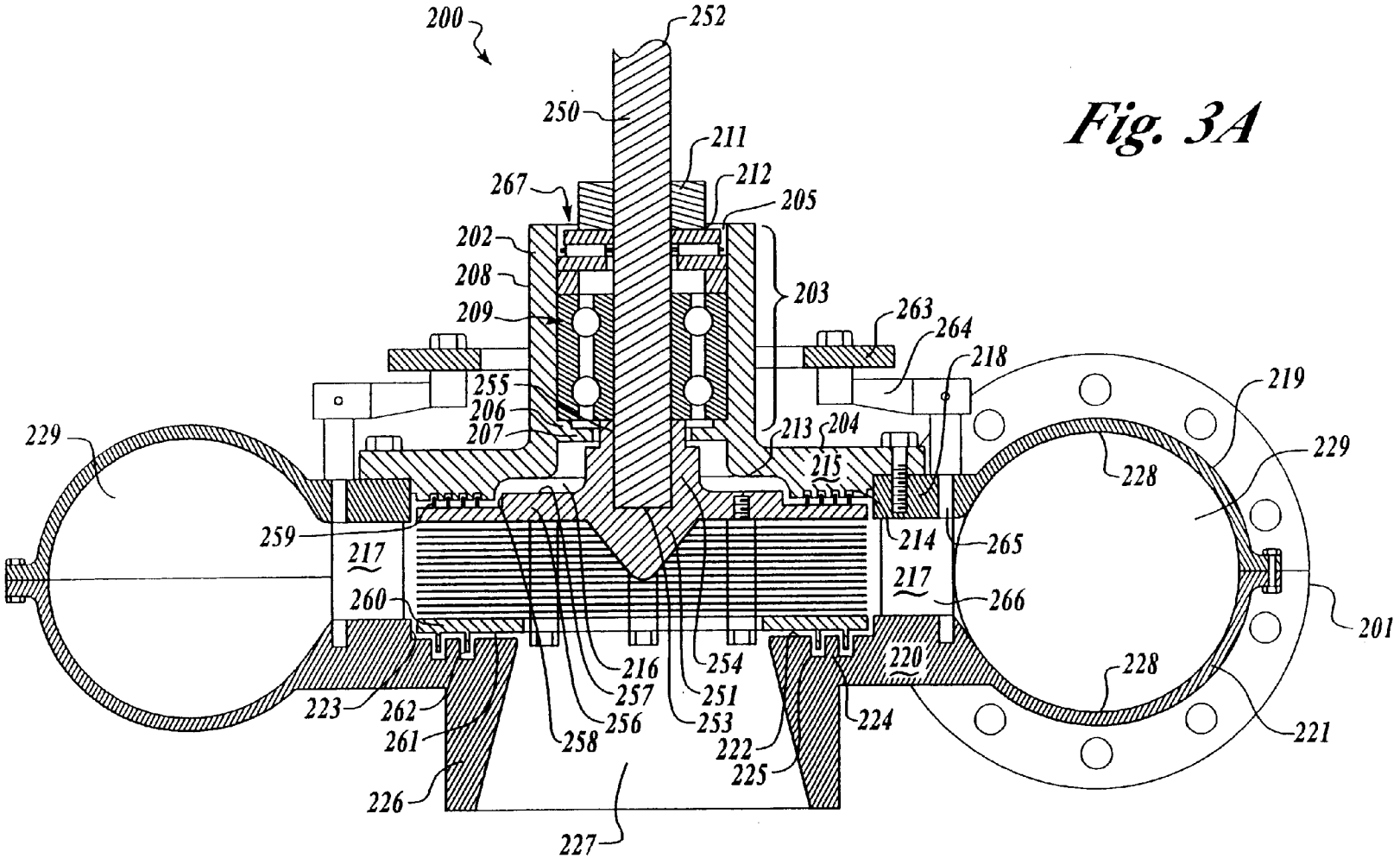
FIG. 3A depicts a cross-sectional side view of a hydroelectric turbine incorporating the impeller assembly.
Figure 3B:
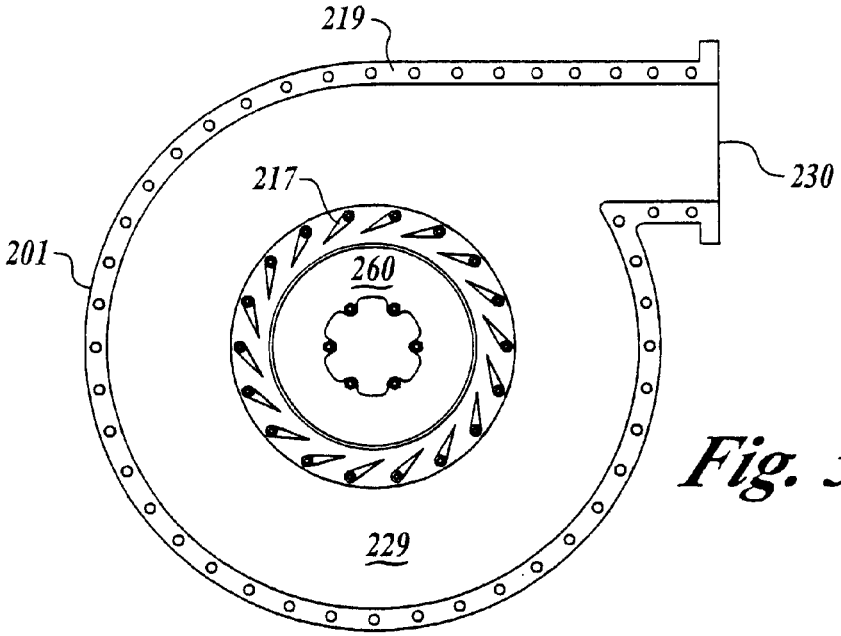
FIG. 3B shows a cross-sectional top view of the top half of the housing.
Figure 3C:
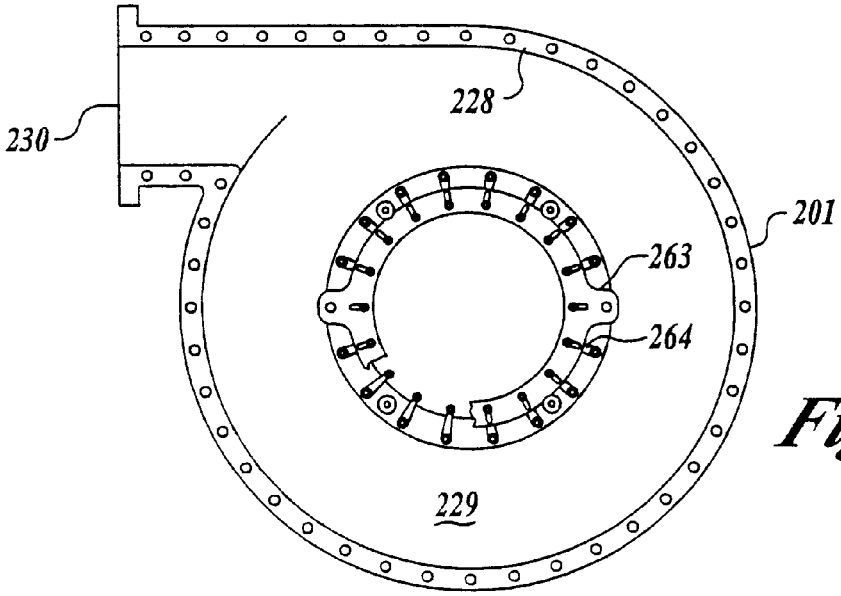
FIG. 3C illustrates a cross-sectional top perspective of the top half of the housing with the shifting ring connected to the wicket gates.
Figure 3D:
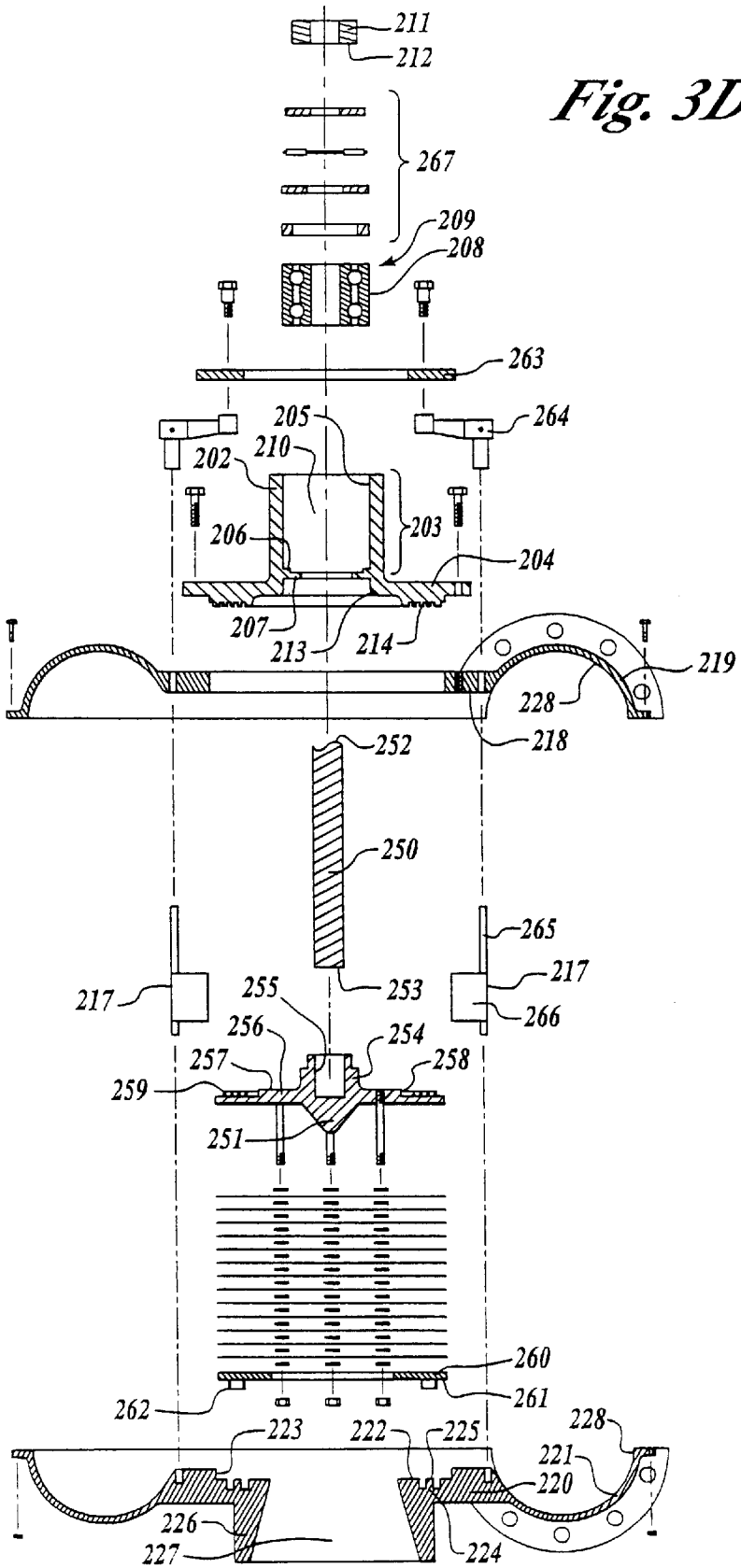
FIG. 3D is an exploded illustration of a cross-sectional side view of the hydroelectric turbine.

FIG. 2A is a cross-sectional side view illustrating the arrangement of impeller assembly 1 within jet pump housing 101. Jet pump housing 101 may be made of any suitable material including cast and/or machined metals and/or metal alloys such as iron, steel, aluminum, titanium, and the like, as well as ceramics and plastics. Jet pump housing 101 possesses an exterior 102 and interior wall 103, which forms an internal chamber 104 of sufficient volume to accommodate impeller assembly 1 and maintain a gap 105 between discs 2 and backing plates 9, 12 of the impeller assembly. In certain applications, gap 105 is between from 1/100 to greater than 2 inches, preferably from 1/32 to 1 inch, and more preferably from 1/16 to ½ inch, and in this exemplary embodiment, around ¼ inch, depending on size and amount of particulates in the fluid medium. It is understood the gap may extend beyond this range for optimal performance under certain conditions for various embodiments of the invention. Shaft section 16 of central hub 15 in the impeller assembly is supported by a series of support bearing assemblies 106 housed within a cavity 107 formed by support collar 108, which is an extension of the jet pump housing. The floor of cavity 107 housing support bearing assemblies 106 is formed by a flange section 109 extending from interior wall or support collar 108. Extending from flange section 109, is a lip 123, which provides a seat for a top seal 124 and a bottom seal 125. Bearing support assemblies 106 are retained within support collar cavity 107 by a retaining ring 111, or comparable retaining device, fixedly associated with shaft section 16, thereby providing structural support to the impeller assembly. As previously noted, the bearing/seal assembly may be of any appropriate configuration that provides sufficient support and permit as friction-free radial movement of the shaft as possible, as well as prevent any leakage from the internal chamber. The seals utilized in the system may be of various configurations and compositions, so long as they are non-reactive and wear-resistant. Suitable materials include rubber, urethane, polyurethane, silicone, other synthetic materials, and the like.

The floor of internal chamber 104 is defined by a cover 116, having a bottom plate 112 with a central aperture 113. The diameter of the central aperture of the bottom plate is roughly equivalent to the diameter of the central aperture of the backing plates and discs. Integral with the bottom plate is a cowl section 122, having a grated section defining a grated inlet port 120. The interior surface 115 of bottom plate 112 is recessed 114 to accommodate distal ends 7 of connecting rods 5 and associated retaining mechanism 8. This feature permits interior surface 115 of bottom plate 112 to be in close association with outside face 14 of the inlet-side backing plate 12, preferably in the range of 1/32 to 2 or more inches and more preferably in the range of 1/16 to 1 inch and even more preferably from ⅛ to ½ inch. Cover 116 (FIGS. 2A and 2C) is fixedly attached to jet pump housing 101 by any appropriate securing device, such as a bolt threaded through a plurality of apertures 117 formed in the flange section 121 of the cover to complementary threaded apertures on the bottom plate. Alternative embodiments of the present invention may incorporate any conventional securing device or mechanism that serves the same purpose. Interior wall 118 of cowl section 122 forms an interior conduit 119 continuous with grated inlet port 120 to permit fluid to pass from the external environment into the internal chamber of the marine jet housing. Inlet port 120 is grated to screen out undesirable material from entering the internal chamber of the jet pump. Inlet port may be covered with any appropriate device that serves to screen out undesirable material.

The marine jet pump employs many of the same principles of operation as the pump system described above. As with the pump system, various connections or associations between the drive system and the marine jet pump, as well as various drive systems are envisioned. In operation, the marine jet pump is partially submersed in a fluid medium and primed to remove air from the system. The drive system is activated to impart radial movement to shaft 16 of central hub 15, turning stacked array of discs 25 through the fluid medium in the direction of arrow 59. As discs 2 of the impeller assembly are driven through the fluid medium, the fluid in immediate contact with viscous drag face 48 of discs is also rotated due to the strong adhesion forces between the fluid and disc. The continued movement of the accelerating fluid from inside perimeter 50 of the discs to outside perimeter 49 of the discs further draws fluid from central cavity 26 of the impeller assembly. The net negative pressure created within internal chamber 104 of the marine jet pump continuously draws fluid through grated inlet port 120 of cover 116 through interior conduit 118 and aperture of the bottom plate 112 to central cavity 26 of the impeller assembly.

As fluid is accelerated through the inter-disc spaces to the outside perimeter of the discs, the continued momentum drives the fluid against the inner wall of the housing chamber creating a zone of higher pressure defined by the gap between the outside perimeter of the discs and the inner wall of the housing chamber. The fluid within the system may circulate a number of times before being displaced through the outlet port. Fluid catch 56 of the inner wall serves to impel the flow of circulating fluid into the central aperture of the outlet port. The fluid is driven from the zone of relative high pressure 55, as previously described above, to a zone of ambient pressure defined by outlet port 60 and any further connections to the system. The exhausted fluid is preferably attached to a standard directional nozzle, or comparable device, to direct the fluid stream into the surrounding water supplying the propulsive force for the marine craft. Alternatively, the present invention may also be fitted with any suitable power head to optimize performance.

The present invention also envisions various modifications to the design presented herein, including one or more inlet and/or outlet ports located at different locations on the jet pump, whether on the front, sides, or bottom of the jet pump housing. Furthermore, the present invention may be mounted to the hull of the vessel in any suitable location at any appropriate angle for optimal performance.

The exemplary description for a marine jet pump is merely illustrative of one of many possible embodiments of a jet system. It is understood that jet systems, as well as any system that drives fluid, such as fluid circulating systems, incorporating impeller assemblies of the present invention are within the scope of the present invention.

3. Impeller Assembly in the Context of a Turbine System

A hydroelectric turbine 200 employing a modified version of the inventive impeller assembly 1 is illustrated in FIGS. 3A–D. The turbine operates under the same general principles of operation as previously described for the pump, but in reverse. Many of the design features of the impeller assembly described above are equally applicable to the turbine embodiments and are therefore incorporated herein, where appropriate. There are distinct differences in the method of operation between pump and turbine systems, although the same basic design of the impeller assembly is utilized. For example, in the pump, the centrifugal and tangential forces imparted to the fluid medium are additive resulting in greater head pressure, which facilitates the expulsion of the fluid medium from the exhaust port. In contrast, the centrifugal forces in the turbine are in opposition to the tangential or dynamic forces of the fluid medium, thereby reducing the effective head pressure and velocity of radial flow to the center of the impeller assembly. As a result, the efficiency of the turbine generally benefits from having a greater number of discs and smaller inter-disc spaces in the impeller assembly, as compared to the pump.

Hydroelectric turbine 200 comprises an impeller assembly contained within a housing comprising several sub-components. The housing may be machined, cast, or a combination of both, and made of any suitable material well known in the art, and in particular, the materials previously mentioned. Integral with the housing is a penstock 201, which surrounds the housing and impeller assembly. The housing is comprised of a top cover 202 having a support collar section 203 and a flange section 204. The interior of the upper portion of the support collar section 203 forms the bearing housing for supporting the shaft of the impeller assembly. One or more bearing assemblies 209 are restrictively retained within the bearing housing by interior face 205 of the upper portion of the support collar section, which is in immediate contact with exterior face 208 of bearing assembly 209. Extending inwardly from the interior face of support collar section 203 is a first rim 206, forming the seat of the bearing housing. Integral with first rim 206 and interior face 205 of the support collar is a second rim 207, which serves as a support for the seal assemblies 267. Alternative designs may employ bushings and bushing-bearing combinations, as well as other comparable assemblies and mechanisms well known in the art. Shaft section 250 of the impeller assembly is supported by compressive forces exerted by bearing assembly 209 and support collar 203 of the housing. This particular arrangement permits low friction radial movement of the impeller assembly while restricting lateral and horizontal movement. The present invention also envisions employing any other conventional apparatus well known in the art to achieve the same results. The upper section of the shaft, distal from the receiving end 252 of shaft, possesses an outwardly extending ring section 211 whose bottom shoulder 212 is in tight association with seal assembly 267, which is in tight association with the top of bearing assembly 209, thereby holding the bearing assembly in tight association against seat 207 of bearing housing. The present invention also envisions any conventional retaining assemblies and mechanisms known in the art for retaining the bearing assemblies other than the ring or collar extending from the body of the impeller shaft, such as a retaining or compression ring fixedly associated with the shaft.

Interior surface 213 of flange section 204 of top cover defines the top section of an upper labyrinth seal 215, which has a first series of grooves 214 formed therein. Interior surface 213 of the top cover 202 also forms the ceiling of an internal chamber 216 within the turbine housing which houses the impeller assembly. The side wall of the internal chamber 216 is defined by a plurality of wicket gates 217 and structural rim 218 of upper body 219 of penstock 201. Wicket gates 217 are pivotably connected to the housing, to permit movement around a central axis. The floor of internal chamber 216 is defined by interior surface 222 of structural rim 220 of lower body 221 of penstock 201. Interior surface 222 of structural rim 220 of lower body 221 is recessed 223 to accommodate the impeller assembly. Interior surface of recessed section 223 has a second series of grooves 225 formed therein to define bottom section 224 of the lower labyrinth seal. Other configurations of labyrinth seals, or other seal assemblies, well known in the art which restrict intrusion of fluid are envisioned by the present invention. For example, there may be a greater or a fewer number of ridges and grooves, or one or more ridges per groove depending on the specific requirements of the particular application. Extending from structural rim 220 of lower body 221 of penstock 201 is a conduit section 226, the interior of which forms exhaust port 227.

The impeller assembly previously described has several modifications to the sub-components to adapt it for use in a hydroelectric turbine. In particular, the central hub comprises two components, the straight shaft section 250 fixedly attached to a hub-plate 251. The hub-plate has a support collar section 254 having an interior wall 255 forming a cavity to receive the connecting end 253 of the shaft. The shaft section may be fixedly joined to the hub-plate by any conventional means to form a tight association, including threaded, welded, keyed, splined, bolted, press-fitted and/or compression connections, and the like. Alternatively, the shaft and the hub-plate may be cast and/or machined as one integral piece. Extending from the collar section of the hub-plate, is the top reinforcing backing plate section 256 with a top surface 257 that is recessed to form the bottom section 258 of the upper labyrinth seal. The bottom section of the upper labyrinth seal has a first plurality of raised ridges 259 that fit into the complementary first set of grooves 214 of the top section of the upper labyrinth seals 215. This configuration, as well as similar configurations, and other seal means well known in the art, serve to restrict the movement of fluid beyond the seal, thereby keeping more fluid flowing over the discs, thereby enhancing the efficiency of the present invention. The modified impeller assembly of the hydroelectric turbine shares the same configuration of discs, spacers, connecting rods, etc as previously described. The aforementioned components for the hydroelectric turbine undergo may require different dimensions and stronger materials to accommodate the greater mechanical stress of the system, but generally, the discs and other components may be of any suitable dimensions. For example, the discs may have a thickness in the range of 0.5 to 40 mm, preferably 1 to 25 mm and more preferably, 2 to 20 mm, and a diameter of 5 to 10,000 mm, preferably, 10 to 5,000 mm and more preferably, 20 to 2,500 mm. In general, the hub-plate is four times thicker than the main discs, although this relationship may vary to accommodate particular applications. Compared to the pump impeller design, the turbine design is more generally more efficient with relatively more discs placed closer together. For example, a typical turbine may have 4 or greater than 40 discs per impeller assembly with an inter-disc spacing of preferably from 1/100 to greater than 2 inches, more preferably from 1/32 to 1 inch, and most preferably from 1/16 to ½ inch, and in the exemplary embodiment presented herein, in the range of ⅛ to ½ inch, or as required by the particular demands of the specific application. The inlet side backing plate 12 described in the previous embodiments has been replaced with a bottom reinforcing/labyrinth seal plate 260. The lower face 261 of the bottom reinforcing/labyrinth seal plate has a second plurality of raised ridges that are fit into the complementary grooves 225 of the bottom section of the lower labyrinth seal, forming the lower labyrinth seal.

Penstock 201 portion of the housing is formed by fixedly joining, by any conventional means, upper body 219 and lower body 221 to define a chamber encircling the impeller assembly and associated structural components. The upper and lower bodies of the penstock each have an interior surface 228 continuous with the other to form an interior conduit 229. Interior surface of the penstock 228 extends outwardly to create a fluid inlet port 230, which may be connected to any additional components for bringing fluid to the inlet port.

In operation, fluid having sufficient velocity enters fluid inlet port 230 and fills interior conduit 229 of penstock 201, creating a zone of high pressure. As fluid pressure increases within the fluid conduit, the fluid is forced through wicket gates 217 and into internal chamber 216 of the housing. Wicket gates 217 are operated by a controlling mechanism, such as a shifting ring 263, which serves as a means of controlling the flow of the fluid into the internal chamber of the housing, and therefore the speed and output of the turbine. Shifting ring 263 is connected to the vertical section 265 of the wicket gate by any conventional connecting assembly 264. Rotational speed of the turbine may be regulated by controlling the volume of fluid flowing through the impeller assembly, as well as the angle at which the pressurized fluid contacts the impeller assembly. To control the volume of fluid, the wicket gates are regulated to adjust the volume of fluid entering the internal chamber of the housing. Regulation of the wicket gates is by a shifting ring, or any other conventional mechanism, which may be controlled by a centrifugal governor. The centrifugal governor is connected to the shifting ring by conventional devices and may be actuated by any suitable controlling mechanism, such as, but not limited to, mechanical and electrical devices, for example, a servomotor and servomechanism. The centrifugal governor is engaged as the turbine reaches a select rotational speed, which in turn rotates the shifting ring adjusting the wicket gates and thereby regulating the volume of fluid and consequently the rotational speed of the turbine. The present invention also envisions employing other conventional controlling mechanism well known in the art.

As the fluid passes into the internal chamber, the pressurized fluid encounters the impeller assembly. The tortuous path of the upper and lower labyrinth seals creates a physical obstacle to the fluid, causing the fluid to preferentially move across the discs of the impeller assembly. With reference to the previous description of the discs of the impeller assembly, moving fluid initially contacts outside perimeter 49 of discs 2 (refer to FIG. 1B), moves across the viscous drag face 48 to inside perimeter 50, and through central aperture 51 of impeller assembly. The fluid continues to flow from regions of high to low pressure until eventually expelled from exhaust port 227. As the fluid moves across the discs, energy is transferred to the impeller assembly through the friction of the fluid in immediate contact with the face of the discs in combination with the adhesive forces of the fluid, causing a continuously decreasing velocity in the fluid. The energy transferred to the discs from the moving fluid is predominantly in the form of tangential or dynamic forces imparted to the discs, which cause the entire impeller assembly to rotate around its central axis. The bearing assembly 209 supports the shaft of the impeller assembly and permits rotational movement of the shaft 250 with a minimum of non-rotational movement. The receiving end of the shaft 252 may be connected by any conventional means known in the art to any number of mechanical devices for utilizing or applying the rotational movement produced thereby.

Figure 4A:
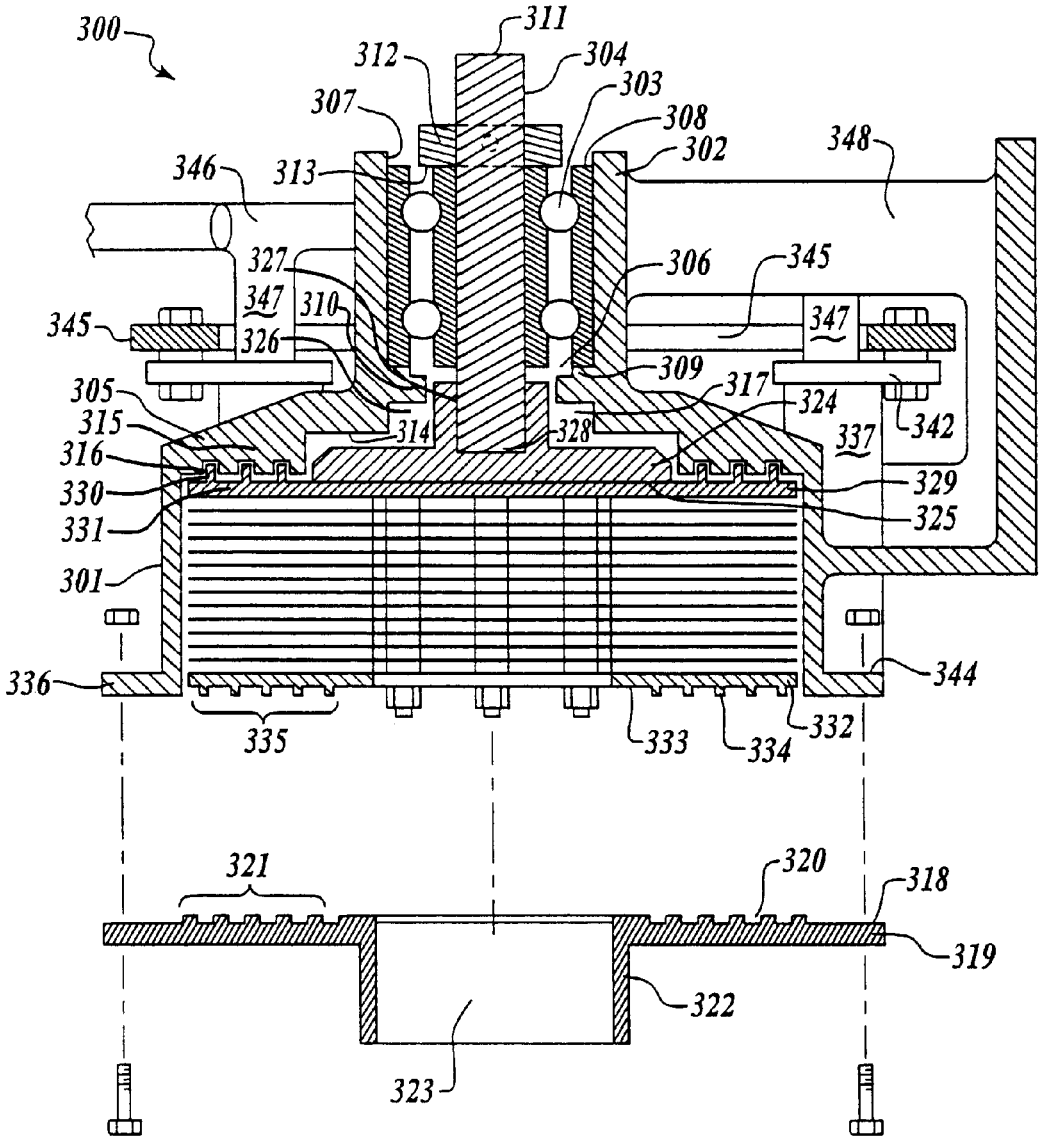
FIG. 4A illustrates a cross-sectional side view of the fluid turbine with the end cover unattached.
Figure 4B:
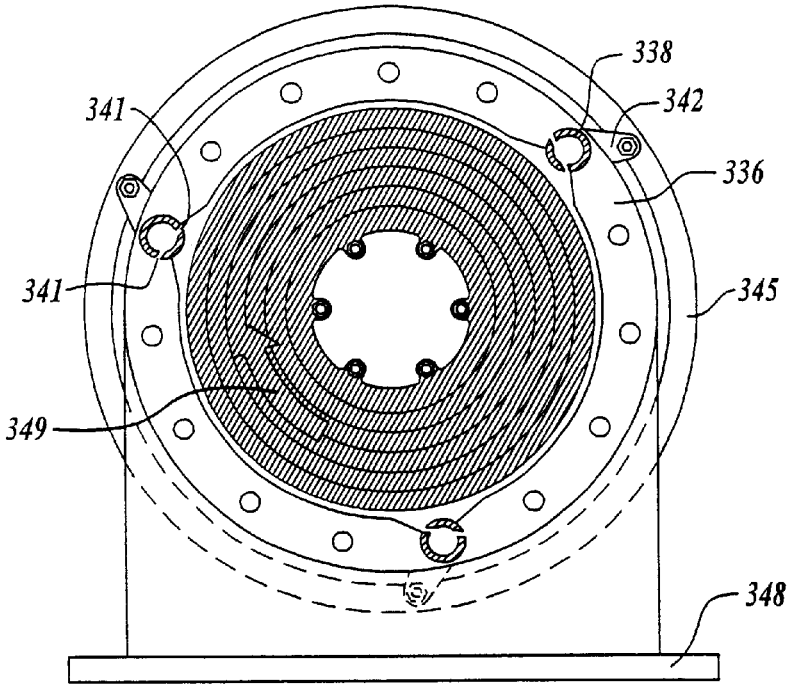
FIG. 4B shows a bottom perspective of the fluid turbine with the end cover removed to expose the cross-sectional view of the reversing nozzles. For simplicity, only the bottom reinforcing/labyrinth seal plate is shown in the internal chamber of the main housing.
Figure 4C:
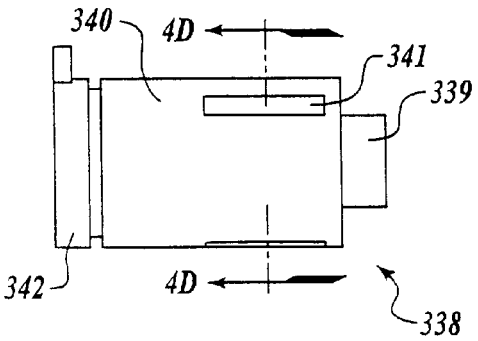
FIG. 4C illustrates a side view of a reversing nozzle.

A fluid turbine 300 employing a modified version of the inventive impeller assembly 1 is illustrated in FIGS. 4A–C. The fluid turbine comprises an impeller assembly contained within a main housing 301 comprising several subcomponents. The general design and principles of operation of the impeller assembly has been previously described and, where applicable, are incorporated into the description of this embodiment of the present invention. For example, in some embodiments, the impeller assembly includes a central hub, and a stacked array of parallel discs, each disc having a central aperture and being inter-spaced along a parallel axis. The main housing has a narrower support collar section 302 which houses one or more bearing assemblies 303 that support the shaft 304 of the impeller assembly.

The main housing has a bell-shaped section 305 continuous with collar support section 302. A structural brace section 348 connects the two sections of the main housing described above. The interior of the upper portion of the support collar section of the top cover defines the bearing housing 306 for supporting the shaft of the impeller assembly. One or more bearing assemblies 303 are restrictively retained within bearing housing 306 by interior face 307 of the upper portion of the support collar section, which is in immediate contact with an exterior face 308 of bearing assembly 303. Extending inwardly from interior face 307 of the support collar section is a first rim 309, forming the seat of the bearing housing. Integral with first rim 309 and interior face 307 of support collar is a second rim 310, which serves as a seal support surface. Shaft section 304 of the impeller assembly is supported by the compressive forces exerted by the bearing assembly and support collar of the housing. This arrangement permits low friction radial movement of the impeller assembly while restricting lateral and horizontal movement. The upper section of the shaft, distal from the receiving end 311 of the shaft, possesses a retaining device, such as a retaining ring 312 whose bottom shoulder 313 is in tight association with the top of bearing assembly 303, thereby holding bearing assembly against seat 309 of bearing housing 306. The present invention also envisions other retaining means for holding the bearing assemblies other than the retaining ring, such as a compression ring fixedly associated with the shaft. The present invention may also employ any conventional retaining devices known in the art, including, but not limited to, a sir clip, locking bolt, snap ring, taper lock and press fit.

Interior surface 314 of bell section 305 of main housing forms the top section of the upper labyrinth seal 315, which has a first series of grooves 316 formed therein. Interior surface of the top cover also defines the ceiling and sides of an internal chamber 317 within the main housing which houses the impeller assembly. The floor of the internal chamber is defined by interior surface 318 of end cover 319, which has a second series of grooves 320 formed therein to create the bottom section of the lower labyrinth seal 321. Other configurations of labyrinth seals or other seal mechanisms for restricting the intrusion of fluid well known in the art are envisioned by the present invention. Extending from the end cover is a conduit section 322, which defines the exhaust port 323.

Figure 4D:
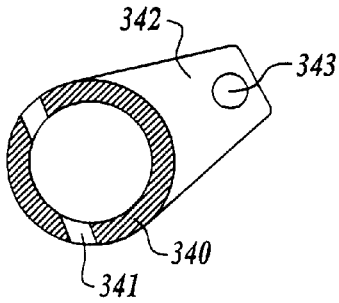
FIG. 4D show a cross-sectional bottom view of a reversing nozzle.
Figure 4E:
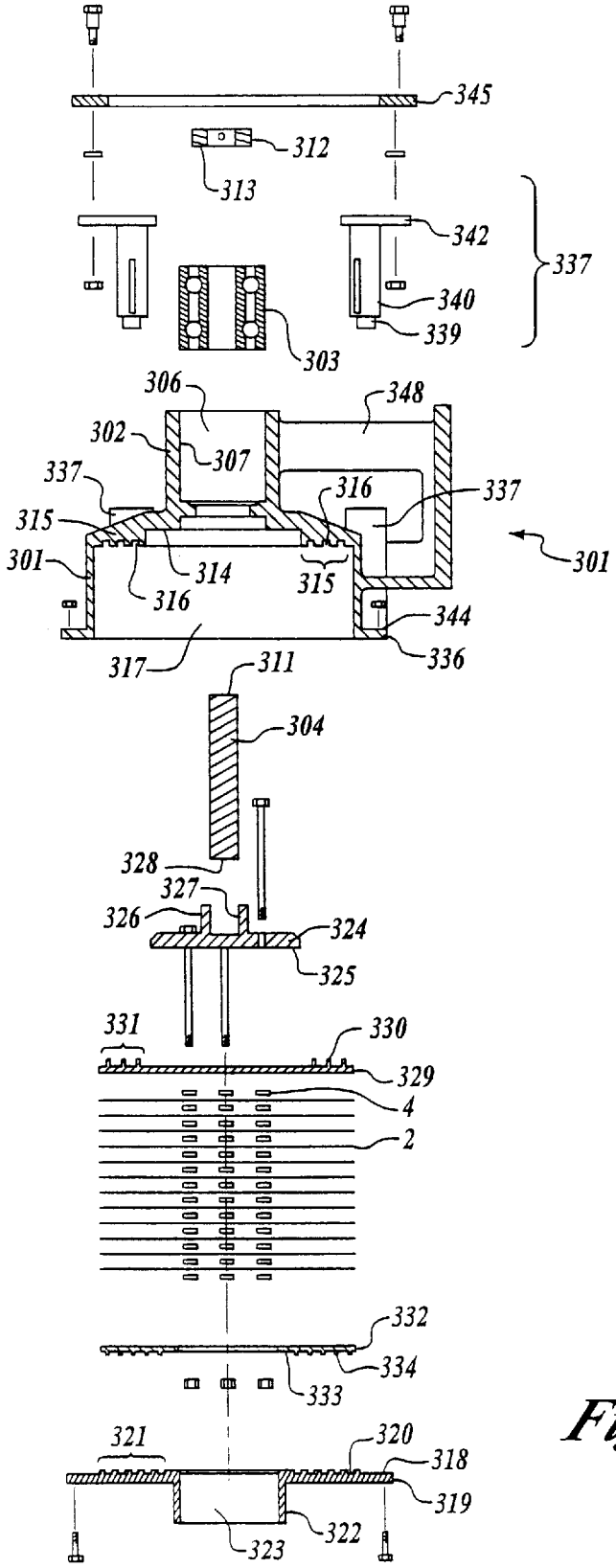
FIG. 4E depicts an exploded view of a cross-sectional side perspective of the fluid turbine.

The impeller assembly for the fluid turbine has several modifications to the sub-components. In particular, the central hub comprises two components, the straight shaft section 304 fixedly attached to a hub 324. An alternative design may employ a hub-plate design as described in the hydroelectric turbine embodiment described above. The hub has a support collar section 326 having an interior wall 327 forming a cavity to receive the connecting end 328 of the shaft. The shaft section may be joined to the hub by any conventional means to form a tight association, including threaded, welded, brazed, soldered, bonded, compression connections and the like. Alternatively, the shaft and the hub may be cast and/or machined as one integral piece, or may be machined or cast sub-components, as well as any combination of the above. The interior face of the hub 325 is in tight association with the outside face the top reinforcing backing plate section 329. The outside face of the top reinforcing backing plate extending beyond the hub has a first series of raised grooves 330 to form the bottom section 331 of the upper labyrinth seal. First series of raised ridges 330 fit into complementary first set of grooves 316 of the top section of upper labyrinth seals 315. This configuration, as well as similar configurations, and other sealing mechanisms well known in the art, serve to restrict the movement of fluid beyond the seal, thereby keeping more fluid flowing over the discs and out the exhaust port. The modified impeller assembly of the fluid turbine shares the same configuration of discs, spacers, connecting rods, etc as previously described. The aforementioned components for the fluid turbine may require different dimensions and stronger materials to accommodate the greater mechanical stresses of the system. In general, the number of discs, disc dimensions and inter-disc spacing described above apply for the present embodiment, although due to the unique physical attributes of fluid, the inter-disc spacing may be in the range of 1/100 to several inches, preferably 1/64 to 2 inches and more preferably 1/16 to ½ inch. The inlet side backing plate 12 described in previous embodiments has been replaced with a bottom reinforcing/labyrinth seal plate 332. Lower face 333 of bottom reinforcing/labyrinth seal plate 332 has a second plurality of raised ridges 334 that fit into complementary grooves 320 of the bottom section of the lower labyrinth seal, forming the lower labyrinth seal. As shown in FIG. 4D, an end cover 319 is fixedly attached to a flange section 336 of the main housing by any conventional devices known in the art, including, but not limited to, the nut and bolt arrangement depicted in the illustration. In addition, any conventional methods of sealing the end cover to the main housing are envisioned, such as gaskets, O-rings and the like.

The main housing of the fluid turbine has a plurality of reversing nozzle housings 337 that are integral with the bell-shaped portion 305 of the main housing, such that the interior of the reversing nozzle housings are open to the internal chamber 317 of the main housing. The openings of the reversing nozzle housings serve as a series of inlets for the fluid. A plurality of reversing nozzles 338 (FIG. 4C) are set into a complementary plurality of reversing nozzle housings 337 by means of a mounting post 339 that is pivotally mounted into the base of reversing nozzle housing 344. The body 340 of the reversing nozzles defines a conduit having a series of slots 341 through which fluid is directed. A controlling mechanism, such as a shifting ring 345, or other device, regulates the reversing nozzles. In this particular embodiment, the reversing nozzles are rotated by means of a shifting ring 345, as shown in FIG. 4B. Shifting ring 345 is fixedly attached to an arm portion of the cap 342 of reversing nozzles by any conventional means; for example, a bolt assembly through an aperture in cap 343 and a complementary aperture in the shifting ring. The reversing nozzles are arranged in the reversing nozzle housings such that the slots may be exposed to the impeller assembly within the internal chamber of the housing by turning the shifting ring.

A fluid source is connected by any conventional device to fluid inlet conduit 346, having a plurality of fluid supply conduits 347 branching to, and connecting with, reversing nozzles. In operation, fluid of sufficient pressure is channeled into the fluid inlet conduit, where it is directed to supply conduits 347 and into the reversing nozzles. To engage the impeller assembly, the shifting ring is turned to adjust the reversing nozzles to align the complementary slots of each nozzle with the internal chamber of the main housing. The fluid is forced through the slots into the internal chamber and where the fluid contacts the impeller assembly. The tortuous path of the upper and lower labyrinth seals creates a physical obstacle to the fluid, causing the fluid to preferentially move across the discs of the impeller assembly. The pressurized fluid initially contacts outside perimeter 49 of the discs (refer to FIG. 1B), moves across viscous drag face 48 to inside perimeter 50 and through the central aperture 51 of the impeller assembly. The fluid continues to flow from regions of high to low pressure until eventually expelled from exhaust port 323. As the fluid moves across the discs, energy is transferred to the impeller assembly through the friction of the fluid in immediate contact with the face of the discs in combination with the adhesive forces of the fluid, causing a continuously decreasing velocity in the fluid as it moves to the inside perimeter of the discs. The energy transferred to the discs from the moving fluid is predominantly in the form of tangential and rotational forces imparted to the discs, which cause the entire impeller assembly to rotate around its central axis. Bearing assembly 303 supports the shaft of the impeller assembly and permits rotational movement of the shaft 304 with a minimum of non-rotational movement. Receiving end of the shaft 311 may be connected by any conventional mechanisms known in the art to any number of mechanical devices for utilizing or applying the rotational movement produced thereby.

The reversing nozzles serve to regulate the speed, torque and direction of rotation of the turbine. In the preferred embodiment, the reversing nozzles have two slots, although additional slots and arrangements of slots may be used. The turbine is capable of reversing direction depending on which of the slots are aligned with the central chamber. As shown in FIG. 4B, the slots are opened to direct the fluid at various angles less than perpendicular to the discs of the impeller assembly, thereby imparting rotational movement in the direction of the arrow 349. To reverse the direction of the turbine, the shifting ring is turned to rotate the reversing nozzles and thereby align the opposite slots of the reversing nozzles with the internal chamber of the housing. The fluid is thereby directed in an opposite direction as previously described and imparts rotational movement of the impeller assembly counter to the arrow. The torque and rotational speed of the impeller assembly is controlled by adjusting the slots of the reversing nozzles relative to the discs of the impeller assembly. As the reversing nozzles are turned, the relative angle of the streaming fluid from the slots varies in relation to the discs (FIG. 4B). As the fluid contacts the discs at a more tangential angle, the turbine has less rotational speed, but greater torque, and when the streaming fluid contacts the discs at a more perpendicular angle, the turbine has greater rotational speed and less torque. As a result, the rotational speed can be finely adjusted by varying the angle of the streaming fluid relative to the discs by rotating the reversing nozzles. The fluid travels across the discs to the central cavity of the impeller assembly and eventually to the exhaust port 323, where it is expelled. The shifting ring may be turned to close both slots of the reversing nozzles to the internal chamber and consequently stop the turbine altogether. In addition, the shifting ring, or comparable device, may be controlled by any suitable means, including manually or mechanically, as well as work in association with regulating devices that monitor speed and direction and provide a reporting signal to controlling mechanisms to mechanically adjust the shifting ring and nozzles.

4. Impeller Assembly in the Context of a Transmission System

Figure 5:
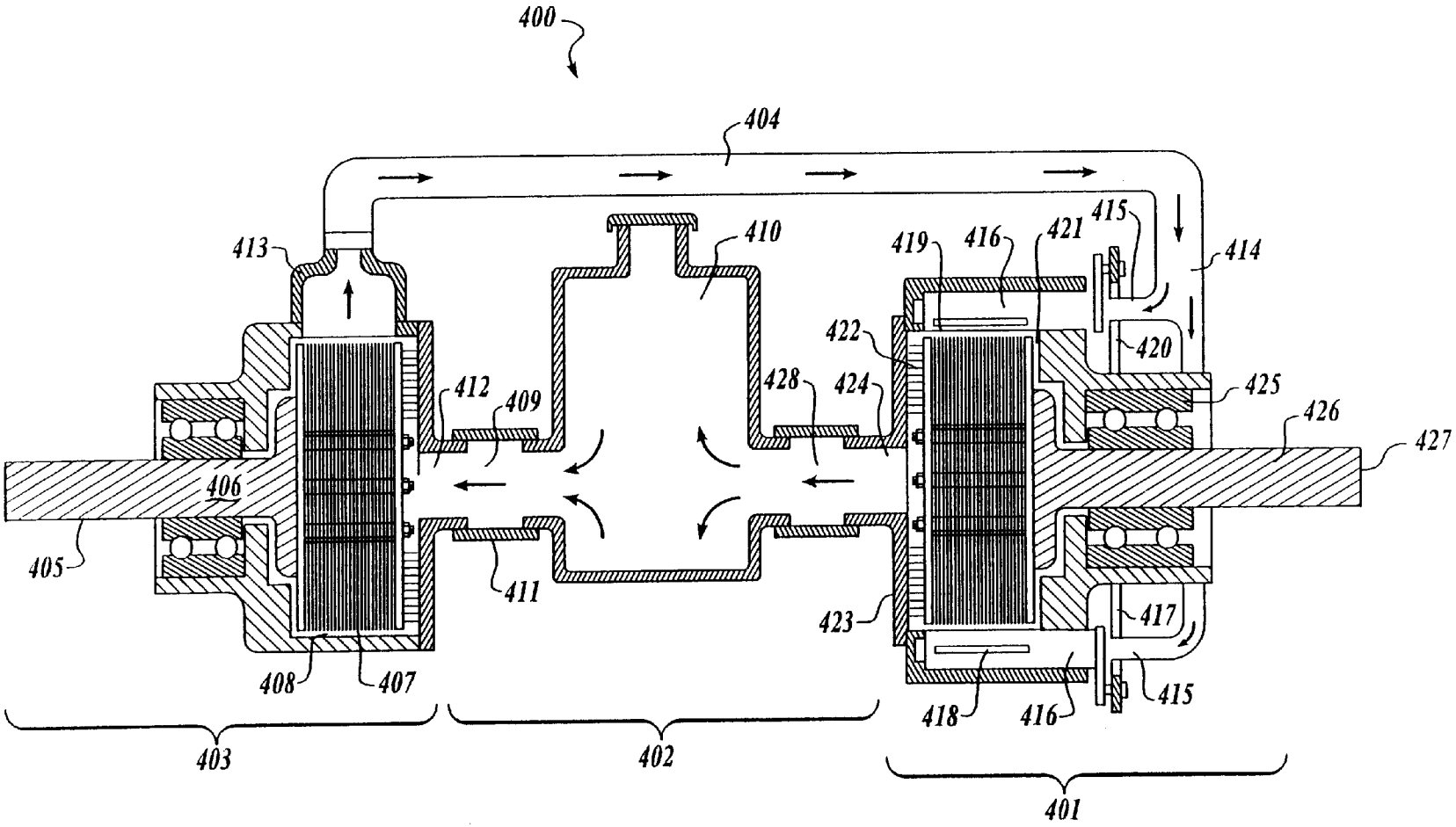
FIG. 5 illustrates a cross-sectional side perspective of a turbine transmission according to one embodiment of the present invention.

A turbine transmission 400, as illustrated in FIG. 5, comprises a turbine section 401, a sump assembly 402, a pump section 403 and a high pressure line 404. The aforementioned subsystems are combined to form one closed system through which a fluid medium flows. Many of the features of the sub-components of the turbine transmission have been described in the detailed description of the pump system and the fluid turbine, and therefore those figures and detailed descriptions are incorporated herein.

Operationally, the turbine transmission is filled with a suitable fluid medium and devoid of any air. A drive system is activated to impart radial movement to the shaft 405 of the central hub 406, turning the stacked array of discs 407 through the fluid medium. As the discs of the impeller assembly are driven through the fluid medium, the fluid in immediate contact with the viscous drag face of the discs is also rotated due to the strong adhesion forces between the fluid and disc. As previously described, the fluid is subjected to two forces, one acting tangentially in the direction of rotation, and the other centrifugally in an outward radial direction. The combined effects of these forces propels the fluid with continuously increasing velocity in a spiral path. The fluid increases in velocity as it moves through the narrow inter-disc spaces causing zones of negative pressure at the inter-disc spaces. The continued movement of the accelerating fluid from the inside perimeter of the discs to the outside perimeter of the discs further draws fluid from the central cavity of the impeller assembly, which is continuous with the inlet port conduit of the inlet port. The net negative pressure created within the internal chamber 408 of the pump section continuously draws fluid from the inlet conduit leading from the sump 410 and connected, by any conventional means 411, to the inlet port 412 of the pump section 403.

As fluid is accelerated through the inter-disc spaces to the outside perimeter of the discs, the continued momentum drives the fluid against the inner wall of the housing chamber creating a zone of higher pressure defined by the gap between the outside perimeter of the discs and the inner wall of the housing chamber. The fluid is driven from the zone of relative high pressure to a zone of relatively lower pressure defined by the outlet port 413 and the high pressure line 404 connected thereto (as illustrated by the arrows).

The pressurized fluid is driven through the high pressure line to the fluid inlet line 414 and to the branching supply lines 415, which connect to the cap sections of the reversing nozzles 416, as previously described in the turbine embodiment. To engage the impeller assembly, the shifting ring 417 is turned to adjust the reversing nozzles to align the complementary slots 418 of each nozzle with the internal chamber 419 of the turbine housing 420. The fluid is forced through the slots into the internal chamber and contacts the impeller assembly. The tortuous path of the upper 421 and lower 422 labyrinth seals creates a physical obstacle to the fluid, causing it to preferentially move across the discs 423 of the impeller assembly. The pressurized fluid initially contacts the outside perimeter of the discs, moves across the viscous drag face of the discs to the inside perimeter, and through the central aperture of the impeller assembly. The fluid continues to flow from regions of high to low pressure until eventually expelled from the exhaust port 424. As the fluid moves across the discs, energy is transferred to the impeller assembly through the friction of the fluid in immediate contact with the face of the discs in combination with the adhesive forces of the fluid, causing a continuously decreasing velocity in the fluid as it moves to the inside perimeter of the discs. The energy transferred to the discs from the moving fluid is predominantly in the form of tangential and rotational forces imparted to the discs, which cause the entire impeller assembly to rotate around its central axis. The bearing assembly 425 supports the shaft 426 of the impeller assembly and permits rotational movement of the shaft with a minimum of non-rotational movement. The receiving end of the shaft 427 may be connected by any conventional means known in the art to any number of mechanical devices for utilizing or applying the rotational movement produced thereby.

As described above, the reversing nozzles serve to regulate the speed, torque and direction of rotation of the turbine. The turbine is capable of reversing direction depending on which of the slots are aligned with the central chamber. The torque and rotational speed of the impeller assembly is controlled by adjusting the slots of the reversing nozzles relative to the discs of the impeller assembly. As the reversing nozzles are turned, the relative angle of the streaming fluid from the slots varies in relation to the discs, thereby controlling rotational speed and torque. The shifting ring can be turned to close both slots of the reversing nozzles to the internal chamber and consequently stop the turbine, and therefore, the transmission completely. In addition, the shifting ring, or comparable device, may be controlled by any suitable means, including manually or mechanically, as well as work in association with regulating devices that monitor speed and direction and provide a reporting signal to controlling mechanisms to mechanically adjust the shifting ring and nozzles.

The fluid is driven across the discs of the turbine to the central cavity of the impeller assembly and eventually driven out the exhaust port 424 and on through the outlet conduit 428 connected by any conventional means 429 to the sump 410. The fluid expelled from the turbine is driven into the sump where it is recycled. The fluid is eventually drawn back into the pump section, where the cycle repeats itself. The drive mechanism applying rotational movement to the impeller assembly of the pump section drives the fluid to impart rotational movement of the impeller assembly of the turbine section thereby providing complementary rotational movement at the turbine's shaft, which may be utilized in any number of ways.

5. Impeller Assembly in the Context of a Fuel Turbine System

One embodiment of fuel turbine employing a modified version of the inventive impeller assembly is illustrated in FIGS. 7A–D. The fuel turbine operates under the same general principles of operation as previously described for the various embodiments of the turbines described above, such as the turbine transmission, but adapted to ignite fuel and thereby create power. Many of the design features of the impeller assemblies described above are equally applicable to the turbine embodiments and are therefore incorporated herein, where appropriate.

Figure 7A:
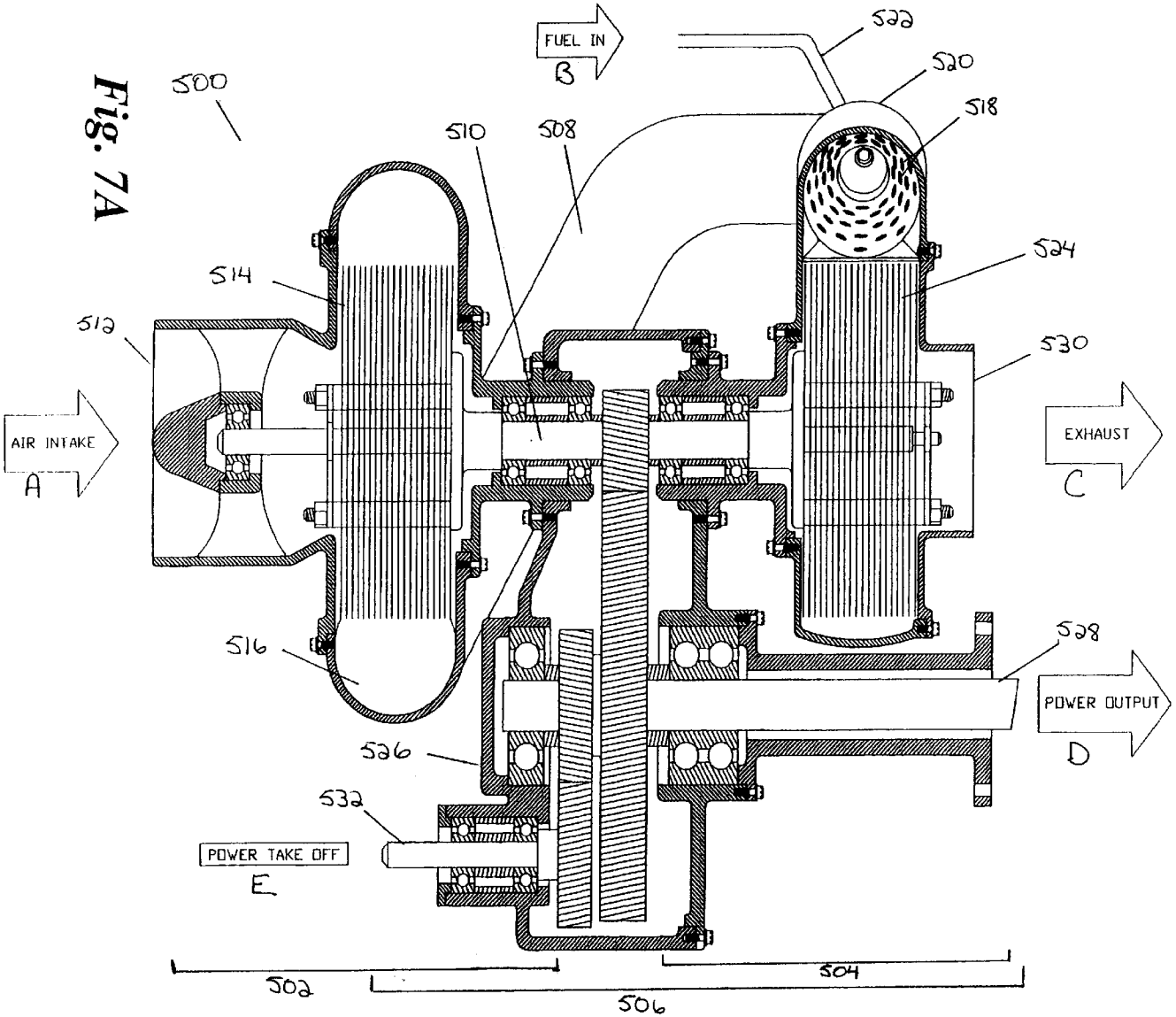
FIG. 7A illustrates a cross-sectional side perspective of a gas turbine according to one embodiment of the present invention.

In general, as depicted by one embodiment in FIG. 7A, the fuel turbine includes a compressor section to create high pressure fluid, a power section to ignite fuel and increase pressure and/or a gear section to transfer rotational power. The illustration shows one embodiment of fuel turbine 500 having a compressor impeller section 502 in fluidic communication with a power impeller section 504 by a transfer link 508 and a gear section 506 in mechanical communication with the compressor section and power section by a main shaft 510. However, other embodiments may include a compressor impeller section according to the present invention in connection with a conventional power section or a conventional compressor section in connection with a power impeller section according to the present invention. Furthermore, the sections of the fuel turbine may be interconnected or in communication by a variety of components and positions, in addition to those described herein.

The compressor impeller section 502 comprises a fluid intake port 512 to feed flowing fluid, depicted as arrow A, such as air or other fluids to ignite fuel, to a compressor turbine 514. The compressor turbine 514 increases the pressure of the fluid. Similar to the pump described above, the centrifugal and tangential forces imparted to the fluid medium in the compressor turbine are additive resulting in greater head pressure, which facilitates the expulsion of the fluid medium from a fluid output 516 in fluidic communication with one or more transfer link(s) 508. The transfer link may be various fluid linking structures, such as a tube, conduit, passageway, etc. that permits the fluid to travel to the power section. Movement of the fluid through the transfer link may occur by building of high pressure fluid in the fluid output 516.

The power impeller section 504 comprises a fluid inlet 518 to receive the released high pressure fluid from the transfer link 508. The fluid inlet is attached to or otherwise in fluidic communication with a combustor unit 520 to permit the high pressure unit to enter the combustor unit. In some embodiments, the fluid inlet may be one or more, e.g. a plurality, of openings in the combustor unit. Furthermore, a fuel inlet 522 is included to provide fuel, depicted as flow arrow B, to the combustor unit 520. The fuel may be chosen from any convenient combustible fluid for the particular application of the fuel turbine. For example, the fuel may be hydrogen, gasoline, propane, natural gas, combinations thereof, or the like. The combustor unit 520 also may be various combustors to ignite fuel and create very high pressure fluid which is known or may be currently known or developed in the future.

A power turbine 524 receives the very high pressure fluid that has been ignited and creates rotational energy. As described above with regard to the turbines, tangential or dynamic forces of the fluid medium are transferred to rotational energy across a series of discs. The power turbine transfers the rotational energy to the main shaft 510 of the gear section 506 thereby causing the main shaft to rotate. The rotational force of the main shaft may be transferred to the compressor turbine to cause rotation of an array of discs. In some embodiments, the main shaft is in mechanical communication, such as through one or more gears that may be contained in a gear housing 526, to an output shaft 528 to output the rotational power, depicted by output arrow D. An exhaust port 530 is also provided to permit fluid, depicted as flow arrow C, to exit from the power turbine after the rotational energy is produced. In some embodiments, a starter 532 is also provided to initiate rotational movement of the central hub of the compressor section, such as by rotation of the main shaft, and thereby to activate the compressor turbine. The starter may activate the compressor section prior to the power section perpetuating rotational movement in the main shaft. The starter may transfer rotational energy received from external mechanical sources, depicted as input arrow E.

Figure 7B:
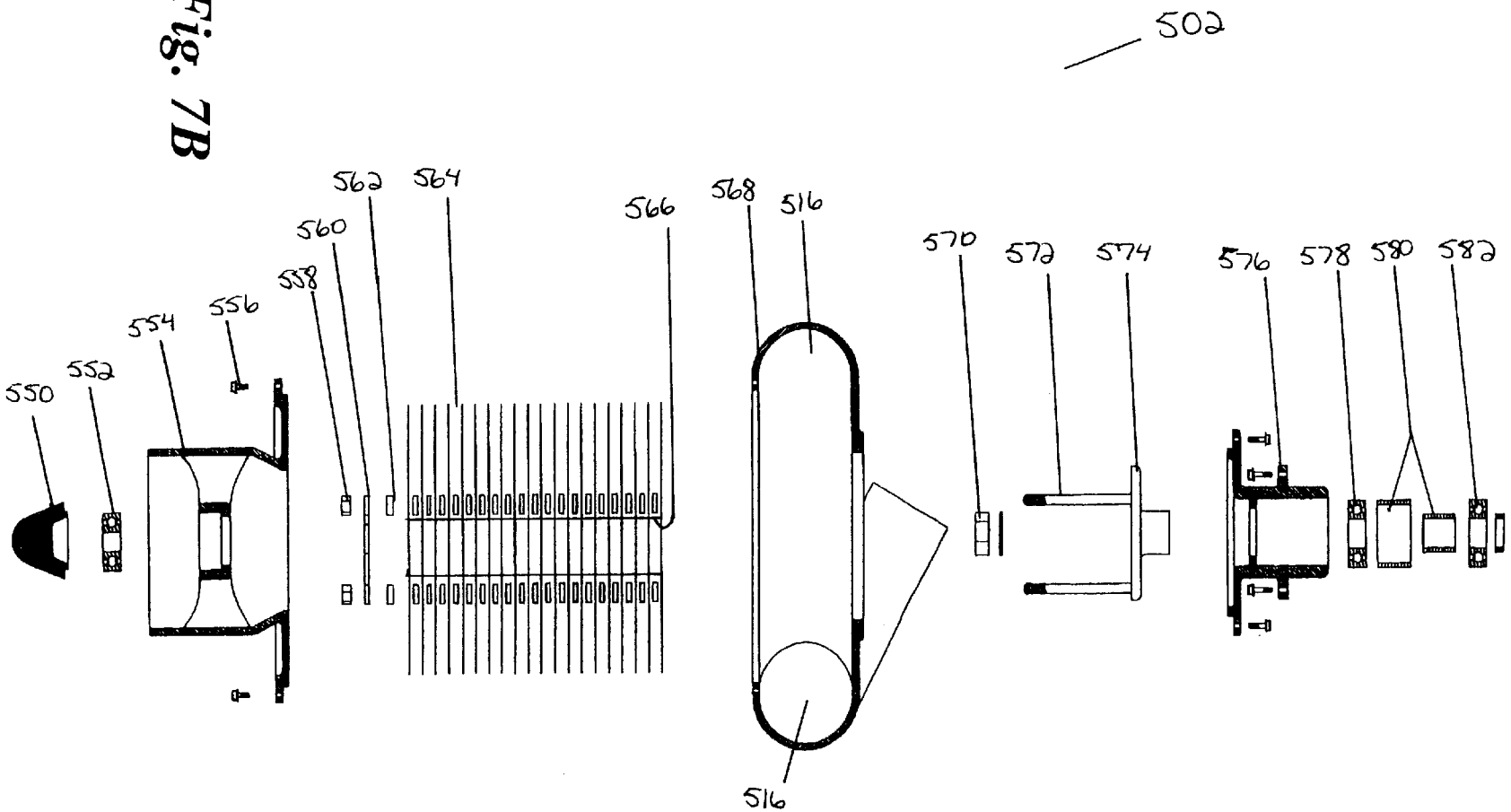
FIG. 7B depicts an exploded view of the compressor section of the gas turbine of FIG. 7A.

Some additional components that may be included in the compressor impeller section 502 are depicted in the exploded view in FIG. 7B. An end housing 554 may define the fluid intake port 512 (shown in FIG. 7A) to permit fluid to enter the compressor turbine to a central cavity 564 in an array of parallel discs 562 of the compressor turbine. In some embodiments, the main shaft (as illustrated in FIG. 7A) may extend through the array of discs and a shaft securing mechanism 552, such as one or more bearings, may be provided in end housing 554 to retain and support an end of the main shaft. Furthermore, the shaft securing mechanism 552 may be protected from inflowing fluid and other environmental elements by a cover 550, such as a cap. In other embodiments, the main shaft may not extend through the central cavity 564 and an end of the main shaft may be fixedly secured to a central hub 572. In any case, the central cavity is usually devoid of any protruding components, such as parts having abrupt edges, rough textures, and the like, that may cause turbulence or otherwise disrupt the flow of fluid through the central cavity. An extending main shaft, where provided, is usually smooth without attachment components present in the central cavity, thereby permitting smooth flow of fluid through the cavity passed the shaft.

The array of discs 562 may be the same or similar to the disc array described above with regards to the impeller assembly. Oftentimes, in fuel turbine applications, the discs may be thicker in dimension than the discs used in non-fuel impeller applications. The thicker dimension may permit the discs to be rigid under the very high rotational speeds that may occur. This high rotational speed may be, for example, between 15,000 to 35,00 rpm compared to 450 to 10,000 rpm that may occur with non-fuel applications. Furthermore, in some embodiments, the discs may be comprised of a rigid and light material, such as titanium, ceramic, etc. Because of the flex resistant characteristic of these stronger plates, first and/or second backing plates may be not be necessary and may be excluded from this embodiment of turbine. However, it is also intended that in other embodiments of the present invention first and/or second backing plates may be included as described above. The number of discs and spacing may be determined in relation to the type of fuel used and application of the turbine.

The compressor turbine may also include two or more rods 570 extending through the discs, as described above with regard to the impeller assembly. A support frame 560 may be provided to support the end of the rods that is opposite of the end of the rods supported by the central hub 572. One or more retaining device(s) 558, such as a nut, may secure the rod ends against the support frame. Where the shaft extends through the array of disc, the support frame may also include a shaft attachment as described above with regards to FIG. 6B. In embodiments where the shaft does not pass through the discs, the support frame may not include a shaft attachment. The support frame may be separated from the discs by one or more spacer(s) 562. A hub nut 570 or other such securing mechanism, may also be provided to secure the central hub 572.

A compressor housing 568 is provided to contain the compressor turbine, including the discs, rods, central hub, support frame and/or shaft. The compressor housing often includes one or more fluid output 516 that may collect high pressure fluid from across the discs and that may be in communication with a transfer link. The end housing 554 may be coupled to the compressor housing 568 by a bolt 556 or other such securing mechanisms.

Various securing and supporting mechanisms may also be provided to couple the compressor section to the gear section and/or power section. These mechanisms may also provide for support for the main shaft, gears, etc. of the gear section. For example, a support bearing housing 576 may contain one or more bearings 578, 582 that may be separated by one or more spacers 580.

Figure 7C:
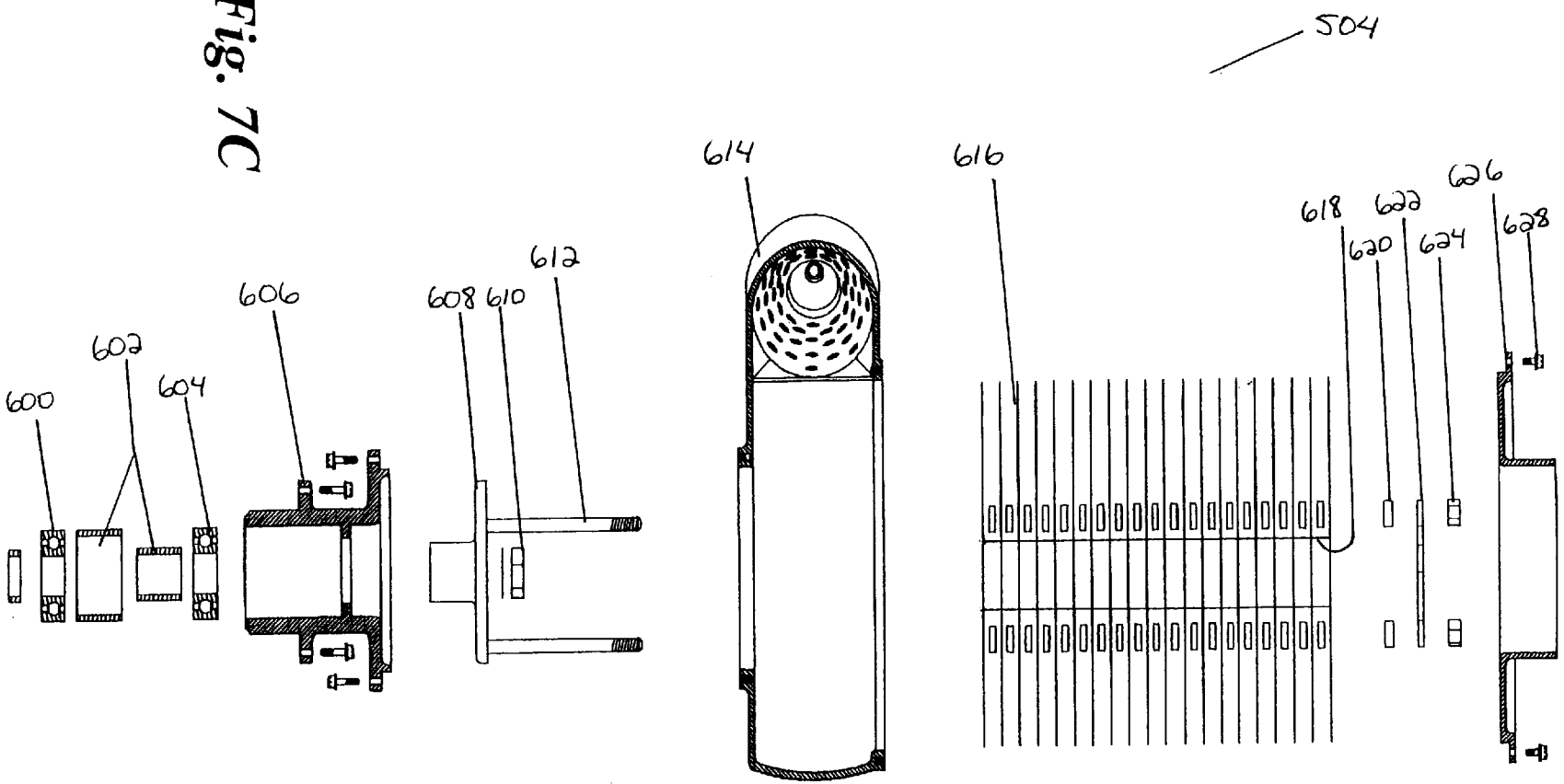
FIG. 7C depicts an exploded view of the power section of the gas turbine of FIG. 7A.

Some additional components that may be included in the power impeller section 504 are depicted in the exploded view in FIG. 7C. Various securing and supporting mechanisms may be provided to couple the power section to the gear section and/or compressor section. These mechanisms may also provide for support for the main shaft, gears, etc. of the gear section. For example, a support bearing housing 606 may contain one or more bearings 600, 604, which may be separated by one or more spacers 602.

A combustor housing 614 contains a combustor unit 520 (shown in FIG. 7A) to accept high pressure fluid from the transfer link of the compressor section and expose the fluid to fuel, thereby causing ignition of the fuel. The combustor housing 614 also includes in an array of parallel discs 616 of the power turbine having a central cavity 618. The discs and the central cavity accept the ignited fuel source that is under very high pressure. The discs and central cavity may be the same or similar to the discs and central cavity of the compressor turbine described above. Furthermore, two or more rods 612 may extend through the array of discs and attached to a central hub 608 at one end of the rods, as described for the compressor section. The central hub may be fixedly attached to the array of discs by a securing mechanism 610, such as a nut or bolt. The rods may be supported at their other end by a support frame 622, which may be spaced from the array of discs by one or more spacers 620 and secured by one or more securing mechanisms 624 such as a nut. In addition, the main shaft may either extend through the central hub and central cavity 618 or only extend to the central hub and the central cavity is devoid of such a shaft. An end housing 626 defines an exhaust port 530 (shown in FIG. 7A) to release the ignited fluid leaving the discs.

Figure 7D:
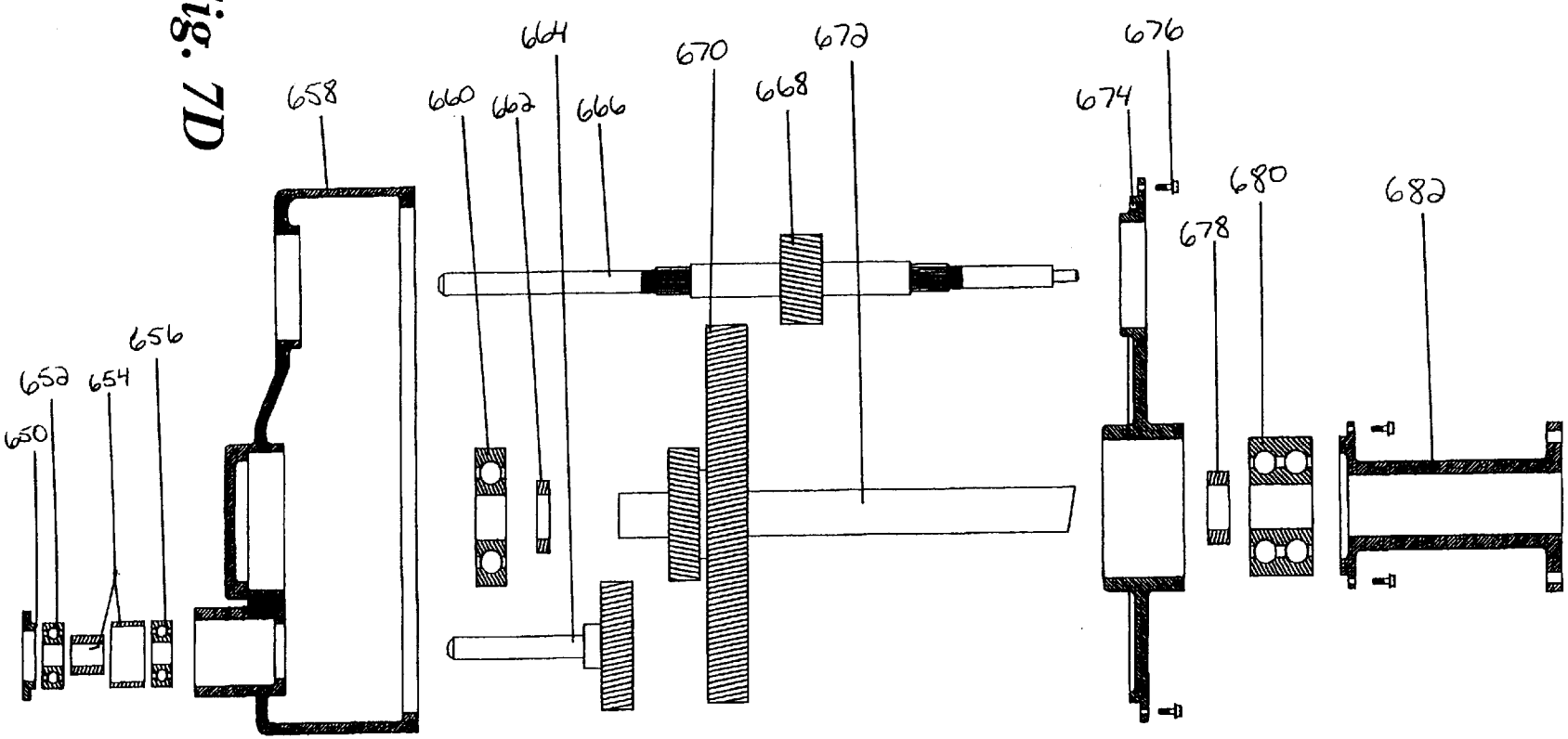
FIG. 7D depicts an exploded view of the gear section of the gas turbine of FIG. 7A.

Some additional components that may be included in the gear section 506 having shafts to provide rotational movement, gears to transfer the rotational movement, securing mechanisms, etc., are depicted in the exploded view in FIG. 7D. A gear reduction housing 658 may contain one or more of the shafts, or portions thereof, gears and various of the securing mechanisms.

The main shaft 666 that extends from the compressor section to the power section may include a main gear 668. The main gear may be coupled to one or more reduction gear(s) 670, which may, in turn, be coupled to an output shaft 672. In some embodiments, a starter shaft 664 may be provided to initiate rotation of the main shaft. The starter shaft 664 may be in mechanical communication with the main shaft 666 through one or more gears, such as the reduction gear 670, main gear 668, etc. Through the rotation of the main shaft, the starter shaft may initiate radial movement of the central hub of the compressor section, and thereby resulting in radial movement of the discs of the compressor section. Oftentimes, the starter shaft is coupled to a starter source located external or internal to the fuel turbine. The starter shaft 664 may be secured to the gear reduction housing by one or more bearings 652, 656 spaced apart by one ore more spacers 654 and by a rethiner 650, or the like.

An end plate 674 and/or extension housing 682 may also contain one or more of the shafts. For example, end plate 674 may be coupled to the gear reduction housing 658 by securing mechanisms 676, such as bolts and the extension housing 682 may be coupled to the end plate. The output shaft 672 may be supported at one shaft end by bearing 660 with spacer 662 and the other shaft end by end plate, bearing 680 with spacer 678 and extension housing. the end plate may also support the main shaft.

The types and numbers of shafts, gears, housings and securing mechanisms may be chosen depending, inter alia, the desired design, shape and size of the turbine and its particular application.

In operation, the central hub of the compressor section is made to rotate to activate the compressor section, such as by the main shaft rotating by a starter. The central hub radial movement results in the discs of the array of stacked discs also radially moving. A fluid entering from the fluid intake port flows through the central apertures of the stacked array of discs forming the central cavity and through the spaces between the discs. Fluid flowing across the discs creates increases the pressure of the fluid. The high pressure fluid is released from the fluid outlet and travels through the transfer link.

Further, fuel is exposed to the high pressure fluid at the power section and the fuel is ignited in the combustion unit. Upon ignition of the fuel, a very high pressure fluid flows across the stacked array of discs in the power section. A shaft is rotated by the fluid flowing across the discs. In some embodiments that includes an output shaft, rotation of the main shaft results in the output shaft rotating. In other embodiments, the main shaft outputs the rotational energy.

There are many benefits to the fuel turbine according to the present invention that may be useful in various applications that are fuel driven. The fuel turbine may create a great amount of power, e.g. between about 50 to 5000 horse power. For example, the coupling of components as described above may permit simple dismantling of components, such as for repair of the turbine system. This easy field-strippable aspect of the turbine may not require specialized repair tools or expertise and thus, the turbine may be suitable for use in vehicles and similar transportation means. The turbine may also be compact in size, permitting its use in a variety of small and large devices. In addition, the fuel turbine of the present invention provides minimal turbulence in fluid flow and rattling of parts and thereby typically does not make great noise, especially in high frequencies, that is common of some other previous and current fuel turbine devices. Any sound created by the combustion of fuel is usually a small amount and at low frequency, which may be easily muzzled. Thus, the present fuel turbine may be suitable in applications where noise pollution is a consideration.

While in the foregoing specification this invention has been described in relation to certain preferred embodiments thereof, and many details have been set forth for purpose of illustration, it will be apparent to those skilled in the art that the invention is susceptible to various changes and modification as well as additional embodiments and that certain of the details described herein may be varied considerably without departing from the basic spirit and scope of the invention.

EXAMPLES

Example 1

Comparison of Viscous Drag Pump with Conventional Vane-Type Pump in Pumping Viscous Fluid A direct comparison of a standard pump, which utilized a typical rotor assembly with vanes, was tested against the present invention. Two identical ⅛ horsepower 3650 rpm motors were fitted with different impeller assemblies. Pump A possessed a conventional vane-type rotor assembly, and pump B possessed the viscous drag impeller assembly. To determine the comparative efficiency of the two types of pumps, the amount of waste oil pumped over time was monitored. The standard pump was unable to transfer the waste oil and was shown to severely overheat during the course of the trial. In contrast, the pump utilizing the viscous drag assembly was able to circulate the oil without strain on the motor.

To facilitate circulation of the viscous fluid and thereby compare the relative efficiency of the two pump designs, the waste oil was heated to 140 F. The pump equipped with the viscous drag assembly was able to transfer three gallons/minute in contrast to only one gallon/minute for the standard pump.

Example 2

Comparison of Impeller Assembly with Standard Rotor

A controlled comparison of a standard rotor and an impeller assembly of the present invention was performed. Two 115 V, ½ hp pump motors (Dayton model # 3K380) were used in this study. One pump was fitted with a conventional rotor pump head (Grainger model #4RH42) having a 3.375" diameter and a rotor depth of ⅜", the other pump was fitted with an impeller assembly of the present invention having a 3.375" diameter, but a 2" rotor depth. Therefore, all motors, bases, plumbing, valves and the like were identical. With valves shut and pumps running, both systems used 7.7 amps. Below is a comparison of the two systems.

| Comparison of Conventional Rotor to Impeller Assembly | Standard Rotor | Impeller Assembly |
|---|---|---|
| Pressure: Valves shut | 17 psi | 19 psi |
| One Valve Open | 10 psi | 13 psi |

-continued

| Comparison of Conventional Rotor to Impeller Assembly | Standard Rotor | Impeller Assembly |
|---|---|---|
| Both Valves Open | — | 10 psi |
| Gallons per minute (+/−5%) | 24.6 | 30 |
| One Valve Open | | |
| Gallons per minute (+/−5%) | — | 48 |
| Both Valves Open | | |
| Amp Readings While Pumping | 8.9 amps | 10.3 amps |

Further analysis comparing a conventional rotor and an impeller assembly of the present invention having the same diameter and rotor depth resulted in similar volume output. Notably, an increase in impeller assembly depth from ⅜" to 2" resulted in only a 10% increase in power consumption, but a significant increase in volume output. Throughout the studies, the noise and vibration levels for the pump employing an impeller assembly of the present invention were significantly less than that of the pump fitted with a conventional rotor.

We claim:

1. An impeller assembly, comprising:

(a) a central hub;

(b) a first reinforcing backing plate fixedly connected to the central hub;

(c) a stacked array of parallel discs fixedly connected to the first reinforcing backing plate, wherein the each disc possesses a central aperture, and wherein the discs are inter-spaced along a parallel axis;

(d) at least two rods to fixedly connect the central hub, the first and second reinforcing backing plates and the stacked array of discs;

(e) a support frame attached to one end of the rods;

(f) a second reinforcing backing plate fixedly attached to the stacked array of parallel discs, wherein the second reinforcing backing plate possesses a central aperture; and (g) a central cavity formed by the central apertures, the central cavity being devoid of a shaft, whereby, upon radial movement of the central hub, a fluid flows through the central apertures of the second reinforcing backing plate and the stacked array of discs and the spaces between the discs.

2. The impeller assembly of claim 1, further comprising a series of spacers having a central aperture, wherein the spacers are fixedly connected to the discs, creating spaces between the discs.

3. A pump, comprising:

(a) the impeller assembly of claim 1;

(b) a housing in which the impeller assembly is contained, creating a complementary surface for the impeller assembly, and wherein a gap is established between the impeller assembly and the housing, defining a zone of high pressure, wherein the housing has an inlet port and an outlet port; and (c) a bearing assembly retained in the housing and in tight association with the shaft section of the central hub for retaining and supporting the impeller assembly, wherein the impeller assembly is radially driven to draw fluid from the inlet port into the central apertures of the backing plate and along the discs and propelled under pressure to the outlet port.

4. A jet pump, comprising:

(a) the impeller assembly of claim 1, wherein the central hub has a shaft section and a flange section;

(b) a housing in which the impeller assembly is contained, creating a complementary surface for the impeller assembly, and wherein a gap is established between the impeller assembly and the housing, defining a zone of high pressure, wherein the housing has an outlet port;

(c) a cover fixedly attached to the housing, having a cowl section, wherein the cowl section has an inlet port; and (d) a bearing assembly retained in the housing and in tight association with the shaft section of the central hub for retaining and supporting the impeller assembly, wherein the impeller assembly is radially driven to draw fluid from the inlet port into the central apertures of the backing plate and along the discs and propelled under pressure to the outlet port.

5. A hydroelectric turbine, comprising:

(a) the impeller assembly of claim 1, wherein the first reinforcing backing plate is integral with the central hub;

(b) a housing in which the impeller assembly is contained creating a complementary surface for the impeller assembly, wherein the housing has a penstock and an outlet port;

(c) a plurality of wicket gates pivotably connected to the housing such that the flow of the fluid to the impeller assembly is regulated;

(d) a controlling mechanism connected to the plurality of wicket gates such that the position of the wicket gates is adjustable; and (e) a bearing assembly retained in the housing and in tight association with the shaft section of the central hub for retaining and supporting the impeller assembly, wherein the impeller assembly is radially driven by the fluid flowing from the penstock through the wicket gates across the discs of the impeller assembly and eventually discharged from the outlet port.

6. A fluid turbine, comprising:

(a) an impeller assembly comprising:

(i) a central hub;

(ii) a first reinforcing backing plate fixedly connected to the central hub;

(iii) a stacked array of parallel discs fixedly connected to the first reinforcing backing plate, wherein the discs possess a central aperture, and wherein the discs are inter-spaced along a parallel axis;

(iv) a second reinforcing backing plate fixedly attached to the stacked array of parallel discs, wherein the second reinforcing backing plate possesses a central aperture, whereby, upon radial movement of the central hub, a fluid flows through the central apertures of the second reinforcing backing plate and the stacked array of discs and the spaces between the discs;

(v) at least two rods extending through the array of parallel discs; and (vi) a support frame attached to one end of the rods;

(b) a housing in which the impeller assembly is contained within creating a complementary surface for the impeller assembly, wherein the housing has a plurality of reversing nozzle housings providing a plurality of inlets, and wherein the housing has an outlet port;

(c) a plurality of reversing nozzles contained within the reversing nozzle housings;

(d) a controlling mechanism connected to the plurality of reversing nozzles such that the position of the reversing nozzles is adjustable;

(e) a fluid inlet conduit connected to the reversing nozzles; and (f) a bearing assembly retained in the housing and in tight association with a shaft of the impeller assembly for retaining and supporting the impeller assembly, wherein the impeller assembly is radially driven by the fluid flowing from the reversing nozzles and through the inlets across the discs of the impeller assembly and eventually discharged from the outlet port.

7. A turbine transmission, comprising:

(a) a pump comprising:

(i) an impeller assembly comprising:

a) a central hub;

b) a first reinforcing backing plate fixedly connected to the central hub;

c) a stacked array of parallel discs fixedly connected to the first reinforcing backing plate, wherein the discs possess a central aperture, and wherein the discs are inter-spaced along a parallel axis; and d) a second reinforcing backing plate fixedly attached to the stacked array of parallel discs, wherein the second reinforcing backing plate possesses a central aperture, whereby, upon radial movement of the central hub, a fluid flows through the central apertures of the second reinforcing backing plate and the stacked array of discs and the spaces between the discs;

(ii) a housing in which the impeller assembly is contained, creating a complementary surface for the impeller assembly, and wherein a gap is established between the impeller assembly and the housing, defining a zone of high pressure, wherein the housing has an inlet port and an outlet port; and (iii) a bearing assembly retained in the housing and in tight association with the shaft section of the central hub for retaining and supporting the impeller assembly, wherein the impeller assembly is radially driven to draw fluid from the inlet port into the central apertures of the backing plate and along the discs and propelled under pressure to the outlet port;

(b) the fluid turbine of claim 6;

(c) a sump section having an sump inlet conduit connected to the inlet port of the pump, and wherein the sump section has an sump outlet conduit connected to the exhaust port of the fluid turbine; and (d) a high pressure line connecting the exhaust port of the pump and the fluid inlet conduit of the fluid turbine, such that a closed system is created, and whereby fluid is drawn from the sump section through the sump inlet conduit and inlet port of the pump and driven by the impeller assembly out the exhaust port of the pump through the high pressure line to the fluid inlet conduit to the reversing nozzles whereby the impeller assembly of the turbine is radially driven and the fluid is eventually exhausted through the exhaust port of the turbine through the sump outlet conduit such that the fluid is continuously recycled.

8. A method for displacing fluids, which comprises:

(a) priming a pump comprising:

(i) an impeller having a central hub; a first reinforcing backing plate fixedly connected to the central hub; a stacked array of parallel discs fixedly connected to the first reinforcing backing plate, wherein the each disc possesses a central aperture, and wherein the discs are inter-spaced along a parallel axis; at least two rods to fixedly connect the central hub, the first and second reinforcing backing plates and the stacked array of discs; a support frame attached to one end of the rods; a second reinforcing backing plate fixedly attached to the stacked array of parallel discs, wherein the second reinforcing backing plate possesses a central aperture; and a central cavity formed by the central apertures, the central cavity being devoid of a shaft, whereby, (ii) a housing in which the impeller assembly is contained, creating a complementary surface for the impeller assembly, and wherein a gap is established between the impeller assembly and the housing defining a zone of high pressure, and (iii) a bearing assembly retained in the housing and in tight association with the shaft section of the central hub for retaining and supporting the impeller assembly;

(b) radially driving the impeller assembly of claims 5 or 6;

(c) drawing fluid from the inlet port into the housing through the central apertures of the backing plate and discs and along the discs;

(d) propelling the fluid through the impeller assembly to the high pressure zone at the gap between the complementary surface of the housing and the impeller assembly; and (e) driving the fluid through the exhaust port of the housing, whereby the fluid is continuously drawn into the inlet port and exhausted through the outlet port.

9. A method for transferring mechanical power from a propelled fluid, comprising:

(a) channeling a propelled fluid to the turbine according to claims 5 or 6;

(b) directing the flow of fluid to the impeller assembly such that the fluid imparts radial movement to the impeller assembly; and (c) exhausting the fluid through the exhaust port, whereby the kinetic energy of the fluid is transferred to radial movement of the impeller assembly.

10. A fuel turbine, comprising:

(a) a compressor impeller assembly comprising:

(j) a central hub;

(ii) a stacked array of parallel discs, each disc having a central aperture, the discs being inter-spaced along a parallel axis, whereby, upon radial movement of the central hub, a fluid flows through the central apertures of the stacked array of discs and the spaces between the discs to increase the pressure of the fluid; and (iii) a fluid outlet to release the high pressure fluid;

(b) a power impeller assembly comprising:

(i) a combustor to introduce the high pressure fluid to the fuel and to ignite the fuel, the combustor having a fluid inlet to receive the released high pressure fluid and a fuel inlet to receive fuel;

(ii) a central hub;

(iii) a stacked array of parallel discs, each disc having a central aperture, the discs being inter-spaced along a parallel axis, whereby, upon ignition of the fuel, a fluid flows across the stacked array of discs;

(iv) at least two rods extending through the array of parallel discs; and (v) a support frame attached to one end of the rods;

(c) a shaft extending from the central hub of the compressor impeller assembly to the central hub of the power impeller assembly, whereby the shaft is rotated by the fluid flowing across the discs of the power impeller assembly; and (d) a starter in communication with the shaft to initiate radial movement of the central hub.

11. A fluid turbine, comprising:

(a) an impeller assembly comprising:

(i) a central hub;

(ii) at least two rods to fixedly connect the central hub and extending through the stacked array of discs;

(iii) a support frame attached to one end of the rods; and (iv) a stacked array of parallel discs, each disc having a central aperture, the discs being inter-spaced along a parallel axis, whereby, upon radial movement of the central hub, a fluid flows through the central apertures of the stacked array of discs and the spaces between the discs;

(b) at least one housing in which the impeller assembly is contained within creating a complementary surface for the impeller assembly, wherein the housing has a plurality of reversing nozzle housings providing at least one inlet, and wherein the housing has an outlet port;

(c) at least one reversing nozzle each contained within the reversing nozzle housing;

(d) a controlling mechanism connected to the plurality of reversing nozzles such that the position of the reversing nozzles is adjustable;

(e) a fluid inlet conduit connected to the reversing nozzles; and (f) a bearing assembly in supporting association with a shaft of the impeller assembly, wherein the impeller assembly is radially driven by the fluid flowing from the reversing nozzles and through the inlets across the discs of the impeller assembly and eventually discharged from the outlet port.

12. A support frame in an impeller assembly having a stacked array of parallel inter-spaced discs, each disc having a central aperture, through which central apertures a fluid flows and along the spaces between the discs, the impeller assembly further having at least two rods extending through the array of discs, the support frame comprising:

(a) at least two rod attachments, each rod attachment for securing one end of each of the rods to the array of discs, and (b) at least two arms having a first arm end being coupled to at least one of the rod attachments.

13. The support frame of claim 12, further including a shaft attachment and wherein a second arm end is coupled to the shaft attachment.

14. A fuel turbine, comprising:

(a) a compressor impeller assembly comprising:

(i) a central hub;

(ii) a stacked array of parallel discs, each disc having a central aperture, the discs being inter-spaced along a parallel axis, whereby, upon radial movement of the central hub, a fluid flows through the central apertures of the stacked array of discs and the spaces between the discs to increase the pressure of the fluid;

(iii) at least two rods extending through the array of parallel discs;

(iv) a support frame attached to one end of the rods; and (v) a fluid outlet to release the high pressure fluid;

(b) a power impeller assembly comprising:

(j) a combustor to introduce the high pressure fluid to the fuel and to ignite the fuel, the combustor having a fluid inlet to receive the released high pressure fluid and a fuel inlet to receive fuel;

(ii) a central hub; and (iii) a stacked array of parallel discs, each disc having a central aperture, the discs being inter-spaced along a parallel axis, whereby, upon ignition of the fuel, a fluid flows across the stacked array of discs;

(c) a shaft extending from the central hub of the compressor impeller assembly to the central hub of the power impeller assembly, whereby the shaft is rotated by the fluid flowing across the discs of the power impeller assembly; and (d) a starter in communication with the shaft to initiate radial movement of the central hub.

15. The fuel turbine of claims 10 or 14, wherein the support frame comprises a shaft attachment.

16. An impeller assembly, comprising:

(a) a central hub;

(a) a reinforcing backing plate fixedly connected to the central hub;

(b) a stacked array of parallel discs fixedly connected to the reinforcing backing plate, wherein the each disc possesses a central aperture, and wherein the discs are inter-spaced along a parallel axis;

(c) at least two rods to fixedly connect the central hub, the reinforcing backing plate and the stacked array of discs;

(d) a support frame attached to one end of the rods; and (e) a central cavity formed by the central apertures, the central cavity being devoid of a shaft, whereby, upon radial movement of the central hub, a fluid flows through the central apertures of the stacked array of discs and the spaces between the discs.

* * * * *